US006020850A

United States Patent [19]

Ji et al.

[11] Patent Number: 6,020,850

[45] Date of Patent: Feb. 1, 2000

[54] OPTICAL CONTROL TYPE PHASED ARRAY ANTENNA APPARATUS EQUIPPED WITH OPTICAL SIGNAL PROCESSOR

[75] Inventors: Yu Ji, Kyoto; Keizo Inagaki, Nara; Nobuaki Imai, Yamatokouriyama; Yoshio Karasawa, Nara, all of Japan

[73] Assignee: ATR Adaptive Communications Research Laboratories, Kyoto, Japan

[21] Appl. No.: 08/916,664

[22] Filed: Aug. 22, 1997

[30] Foreign Application Priority Data

Aug. 22, 1996 [JP] Japan ..... 8-221238

[51] Int. Cl.[7] ..... H01Q 3/02; H01Q 3/12

[52] U.S. Cl. ..... 342/374; 342/368; 342/372

[58] Field of Search ..... 342/368, 372, 342/373, 374, 81, 154

[56] References Cited

U.S. PATENT DOCUMENTS

| | | | |
|---|---|---|---|
| 3,878,520 | 4/1975 | Wright et al. | 343/854 |
| 3,890,598 | 6/1975 | Hagen et al. | 340/6 R |
| 4,965,603 | 10/1990 | Hong et al. | 342/372 |
| 5,029,306 | 7/1991 | Bull et al. | 342/368 |
| 5,202,692 | 4/1993 | Huguenin et al. | 342/179 |
| 5,367,305 | 11/1994 | Völker et al. | 342/368 |
| 5,374,935 | 12/1994 | Forrest | 342/368 |
| 5,400,038 | 3/1995 | Riza et al. | 342/375 |
| 5,512,907 | 4/1996 | Riza | 342/375 |
| 5,818,386 | 10/1998 | Belisle | 342/372 |

FOREIGN PATENT DOCUMENTS 03044202 2/1991 Japan .

OTHER PUBLICATIONS

Gerhard A. Koepf, "Optical Processor for Phased–Array Antenna Beam Formation," Optical Technology for Microwave Applications, SPIE vol. 477, pp. 75–81, 1984.

Takanori Oogoshi, "Lightwave Engineering," Corona Publishing Co., Ltd., Paragraph 4.4, pp. 55–58, Aug. 15, 1982 (partial English language translation attached thereto).

*Primary Examiner*—Thomas H. Tarcza
*Assistant Examiner*—Dao L. Phan

[57] ABSTRACT

Disclosed is an optical control type phased array antenna apparatus having an array antenna of antenna elements. An optical signal processor optically processes input high-frequency signals, and outputs optically processed signals including signal components having phases corresponding to directions in which radio wave signals come and having frequencies equal to those of the input high-frequency signals. Then, each frequency converter mixes a received signal with the optically processed signal in correspondence with the antenna element, and outputs a frequency-converted signal having a frequency of a difference between a frequency of the received signal and a frequency of the optically processed signal. Further, a combiner combines the frequency-converted signals. When reference signals each having a frequency that differs from the frequency of the corresponding radio wave signal by an intermediate frequency are inputted to the optical signal processor as the input high-frequency signals, intermediate frequency signals having the intermediate frequencies and corresponding to the radio wave signals are outputted as received signals from the combiner.

14 Claims, 16 Drawing Sheets

Optical Signal Processor 10

10
Optical Signal Processor
70
71-1
72-1
61-1
62-1
63-1
73-1
71-nc
72-nc
61-nc
62-nc
63-nc
73-nc
71-N
72-N
61-N
62-N
63-N
73-N
17-1
17-nc
17-N
17
Beam B(1)
Beam B(mc)
Beam B(M)
Rw(1)
Rw(mc)
Rw(M)
64-1
64-nc
64-N
65-1
65-nc
65-N
66
68
Demodulator
Demodulated Signal
Transmission and reception Switching Controller 67
Transmission Signal T(M)
Transmission Signal T(mc)
Transmission Signal T(1)
SW
SW1-1
SW1-nc
SW1-M
4-1
4-nc
4-M
a
b
c

OPTICAL CONTROL TYPE PHASED ARRAY ANTENNA APPARATUS EQUIPPED WITH OPTICAL SIGNAL PROCESSOR

BACKGROUND OF THE INVENTION

1. Field of the Invention

The present invention relates to an optical control type phased array antenna apparatus, and in particular, to an optical control type phased array antenna for receiving a plurality of radio wave signals coming in predetermined directions and/or transmitting radio wave signals in predetermined directions, by using an optical signal processor by means of Fourier transform processing a high-frequency signal in an optical space, without executing any digital signal processing.

2. Description of the Prior Art

FIG. 16 is a block diagram of an optical control type phased array antenna apparatus of a first prior art disclosed in the Japanese Patent Laid-Open Publication No. 3-044202.

Referring to FIG. 16, an optical radiator 101 splits a beam of light radiated from a laser diode provided inside the optical radiator 101, into two branched beams of light. One branched beam of light is directly outputted as a first beam of light 103, while the frequency of another branched beam of light is shifted by the frequency of a radio signal inputted from an oscillator 102, and then the frequency-shifted another branched beam of light is outputted as a second beam of light 104.

The first beam of light 103 radiated from the optical radiator 101is incident on an image mask 106 via a mirror 105 and is transmitted through the image mask 106. The image mask 106 transforms the incident first beam of light 103 into a beam of light 107 corresponding to the beam shape of a desired antenna radiation pattern such as a sectoral beam pattern, and then, radiates the transformed beam of light to a Fourier transformation lens 8. Then, the Fourier transformation lens 8 subjects the incident beam of light 107 to spatial Fourier transformation so as to radiate a beam of light 109 of a beam width d after the transformation to a beam combiner 10. On the other hand, the second beam of light 104 radiated from the optical radiator 101 is radiated to a distribution adjuster 131. The distribution adjuster 131 adjusts the width of the second beam of light 104 to a predetermined beam width, and then, radiates the second beam of light after the adjustment as a reference beam of light 132 to the beam combiner 10. The beam combiner 10 mixes and combines the beam of light 109 from the Fourier transformation lens 8 with the reference beam of light 132 from the distribution adjuster 131, and thereafter, radiates a combined light 111 of a beam width d to a fiber array 12.

The fiber array 12 is comprised of a plurality of M sampling optical fibers arranged parallel to one another on a plane so that the lengths of the sampling optical fibers are arranged parallel to one another at predetermined intervals, and the combined light 111 incident on the fiber array 12 is spatially sampled to be incident on the sampling optical fibers. Beams of light incident on the sampling optical fibers are made incident on photoelectric converters 14-1 to 14-M via M optical fiber cables 13-1 to 13-M. Each of the photoelectric converters 14-1 to 14-M photoelectrically converts the incident beam of light into a radio signal which has a frequency of a difference between the first beam of light 103 and the second beam of light 104 and whose amplitude is proportional to the amplitude of the inputted beam of light and whose phase coincides with the phase of the inputted beam of light. Thereafter, the photoelectric converters 14-1 to 14-M output the resulting signals, respectively, to antenna elements 17-1 to 17-N arranged parallel to one another in a straight line or on a plane via power amplifiers 15-1 to 15-M and feeder lines 16-1 to 16-M. With this arrangement, a radio signal is radiated into a free space with a radiation pattern which is previously set by the image mask 106.

Furthermore, an attempt at processing a signal received by an array antenna with a high-frequency signal processed in an optical space (referred to as a second prior art hereinafter) is disclosed in a prior art document of G. A. Koept, "Optical processor for phased array antenna beamforming", SPIE477, pp. 75–81, May, 1984.

However, the optical control type phased array antenna apparatus of the first prior art shown in FIG. 16 has had such a problem that the incoming radio wave signal cannot be received and such a problem that a plurality of radio signals cannot be radiated. Furthermore, the second prior art disclosed in the above-mentioned prior art document has had such a problem that a plurality of signals cannot be received. Furthermore, each of the first and second prior arts is constructed of a beam combiner, and therefore, they have had such a problem that an aligner adjustment for making the optical axes coincide with one another is hardly achieved, and the size of the optical processing system becomes larger.

SUMMARY OF THE INVENTION

An essential first object of the present invention is therefore to provide a compact optical control type phased array antenna apparatus having a simple structure capable of receiving a plurality of radio wave signals coming in predetermined directions.

Another object of the present invention to provide a compact optical control type phased array antenna apparatus having a simple structure capable of receiving a plurality of radio wave signals coming in predetermined directions and transmitting a plurality of transmitting signals by forming high-frequency beams in the directions in which the plurality of radio wave signals come.

In order to achieve the above-mentioned objective, according to one aspect of the present invention, there is provided an optical control type phased array antenna apparatus comprising:

an array antenna comprising a plurality of N antenna elements, said array antenna receiving a plurality of M radio wave signals coming in respective predetermined directions and outputting received radio wave signals;

optical signal processing means for optically processing M input high-frequency signals, and outputting a plurality of N optically processed signals including M signal components having phases corresponding to directions in which the respective radio wave signals come and having frequencies equal to those of the input high-frequency signals, said plurality of N optically processed signals respectively corresponding to said antenna elements;

a plurality of N frequency converting means, provided in correspondence with said antenna elements, each of said N frequency converting means mixing a received signal received by said corresponding antenna element with the optically processed signal outputted from said optical signal processing means in correspondence with said antenna element, and outputting a frequency-converted signal having a frequency of a difference between a frequency of the received signal and a frequency of the optically processed signal; and combiner means for combining a plurality of N frequency-converted signals outputted from said plurality of N frequency converting means, wherein, when a plurality of M reference signals each having a frequency that differs from the frequency of the corresponding radio wave signal by an intermediate frequency are inputted to said optical signal processing means as said input high-frequency signals, M intermediate frequency signals having the intermediate frequencies and corresponding to the radio wave signals are outputted as received signals from said combiner means.

In the above-mentioned optical control type phased array antenna apparatus, said optical signal processing means preferably comprises:

light generating means for generating and outputting a reference beam of light having a reference frequency, and a plurality of M signal-processed beams of light each having a phase equal to that of said reference beam of light and having a frequency that differs by the frequency of the corresponding input high-frequency signal from said reference frequency;

light radiating means for radiating the signal-processed beams of light in substantially identical directions from positions corresponding to the directions in which the respective radio wave signals come and for radiating said reference beam of light in directions substantially equal to the directions of said signal-processed beams of light;

light converging means for converging said signal-processed beams of light and said reference beam of light radiated from said light radiating means on a predetermined image plane, and for forming interference fringes on said image plane;

sampling array means having a plurality of N light detecting means provided at positions corresponding to said antenna elements on said image plane, said sampling array means spatially sampling the interference fringes formed by said light converging means and outputting a plurality of N sampled beams of light corresponding to said antenna elements; and photoelectric converting means for photoelectrically converting said sampled beams of light, and outputting a plurality of N optically processed signals.

The above-mentioned optical control type phased array antenna apparatus preferably further comprises:

a plurality of N phase inverting means provided in correspondence with said antenna elements, for inverting phases of said optically processed signals outputted from said optical signal processing means in either one of the stage of reception and the stage of transmission, and for outputting phase-inverted signals to said respective frequency converting means in the stage of reception and outputting phase-inverted signals to said respective antenna elements in the stage of transmission, wherein, when M transmitting signals modulated by a predetermined modulation method are inputted as said input high-frequency signals to said optical signal processing means, high-frequency beams are formed in the directions in which said M radio wave signals come by radiating said optically processed signals through said respective antenna elements, thereby radiating corresponding transmitting signals into a free space.

The above-mentioned optical control type phased array antenna apparatus preferably further comprises:

a plurality of M input switching means provided in correspondence with the directions in which said radio wave signals come, for selectively switching over between said transmitting signal and said reference signal, and for outputting switched resulting signal to said optical signal processing means; and control means for controlling said input switching means so that the transmitting signal is inputted to said optical signal processing means in the stage of transmission and the reference signal is inputted to said optical signal processing means in the stage of reception.

The above-mentioned optical control type phased array antenna apparatus preferably further comprises:

first switching means provided in correspondence with said antenna elements, for executing switching so that each optically processed signal outputted from said optical signal processing means is selectively inputted to either said frequency converting means or said phase inverting means; and second switching means provided in correspondence with said antenna elements, for executing switching so that each received signal received by each of said antenna elements is inputted to said frequency converting means or each signal outputted from said phase inverting means is inputted to said corresponding antenna element, wherein said control means controls said first and second switching means so that said optically processed signal is transmitted to said antenna element via said phase inverting means in the stage of transmission and said optically processed signal and the received signal received by each of said antenna elements is inputted to said frequency converting means in the stage of reception.

The above-mentioned optical control type phased array antenna apparatus preferably further comprises:

a plurality of N circulators provided in correspondence with said antenna elements, each of said N circulators having first, second and third terminals, each of said N circulators outputting a signal inputted from said phase inverting means via the first terminal to said corresponding antenna element via the second terminal and outputting each received signal inputted from said corresponding antenna element via the second terminal to said frequency converting means via the third terminal;

a plurality of N first band-pass filters provided in correspondence with said phase inverting means, each of said N first band-pass filters band-pass-filtering a signal having a frequency equal to that of the transmitting signal out of inputted said optically processed signals and for outputting a band-pass-filtered signal to said phase inverting means; and a plurality of N second band-pass filters provided in correspondence with said frequency converting means, each of N second band-pass filters band-pass-filtering a reference signal having a frequency equal to that of the input high-frequency signal out of inputted said optically processed signals and for outputting a band-pass-filtered reference signal to said frequency converting means.

In the above-mentioned optical control type phased array antenna apparatus, said optical signal processing means preferably further comprises moving means for moving said radiating means.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Preferred embodiments of the present invention will be described below with reference to the accompanying drawings.

FIRST PREFERRED EMBODIMENT

Figure 1:
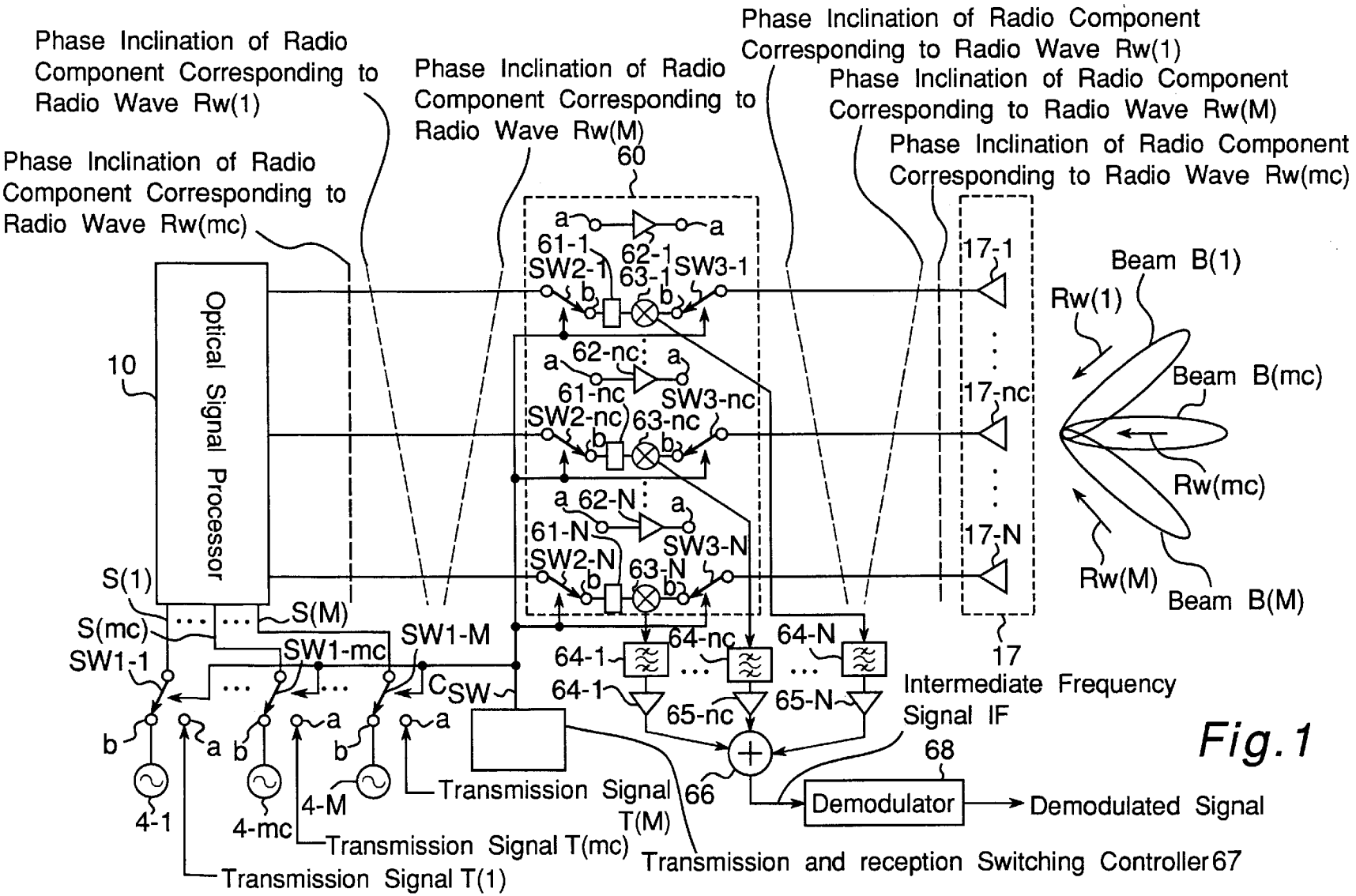
FIG. 1 is a block diagram showing a configuration of an optical control type phased array antenna apparatus according to a first preferred embodiment of the present invention.

FIG. 1 is a block diagram showing a configuration of an optical control type phased array antenna apparatus according to a first preferred embodiment of the present invention. The optical control type phased array antenna apparatus of the first preferred embodiment is characterized in comprising:

(a) an array antenna 17 in which a plurality of N antenna elements 17-1 to 17-N are arranged at equal intervals in a straight line;

(b) a transceiver module 60;

(c) an optical signal processor 10; and (d) a combiner 66, and further characterized in executing transmission and reception as follows.

In detail, the following operations are executed in the stage of reception.

(1) Antenna elements 17-n (n=1, 2, 3, . . . , N; this holds likewise hereinafter in this specification) of an array antenna 17 receive radio wave signals Rw(m) (m=1, 2, 3, . . . , M; this holds likewise hereinafter in this specification) transmitted from a predetermined plurality of M base stations with a phase difference $\beta_m$ corresponding to the directions in which the radio wave signals Rw(m) come, by adjacent antenna elements, and then the received signals R(n) are outputted to the transceiver module 60. In this case, the received signals R(n) have received signal components Re(m, n) corresponding to the plurality of M incoming radio wave signals Rw(m), and the received signal components Re(m, 1) to Re(m, N) have phase inclinations corresponding to the directions in which the M radio wave signals Rw(m) come.

(2) The optical signal processor 10 optically processes a plurality of M inputted input high-frequency signals S(m) so as to generate N reference signals Rc(n) which have reference signal components Rce(m, n) corresponding to the radio wave signals Rw(m) and correspond to the received signals R(n) and outputs the reference signals to the transceiver module 60. In this case, the reference signal components Rce(m, n) are optically processed as described in detail later, and therefore, they have frequencies lower by an intermediate frequency $f_{IF}(m)$ than the frequencies of the received signal components Re(m, n) and have phases inverse to those of the received signal components Re(m, n). That is, reference signal components Rce(m, 1) to Rce(m, N) have phase inclinations inverse to those of the received signal components Re(m, 1) to Re(m, N).

(3) The transceiver module 60 inverts the phases of the reference signal components Rce(m, n) of the reference signals Rc(n), thereafter mixes the inputted received signals R(n) with the corresponding reference signals Rc(n), and then, outputs intermediate frequency signals $IF_A(n)$ having frequencies of the differences between the frequencies of the received signals R(n) and the frequencies of the reference signals Rc(n), to the combiner 66. In this case, the received signals R(n) and the reference signals Rc(n) include a plurality of M received signal components Re(m, n) and a plurality of M reference signal components Rce(m, n), respectively. Therefore, the intermediate frequency signals $IF_A(n)$ include intermediate frequency signal components IF(m, n) having intermediate frequencies $f_{IF}(m)$ of the frequency differences between the received signal components Re(m, n) and the reference signal components Rce(m, n).

Figure 7:
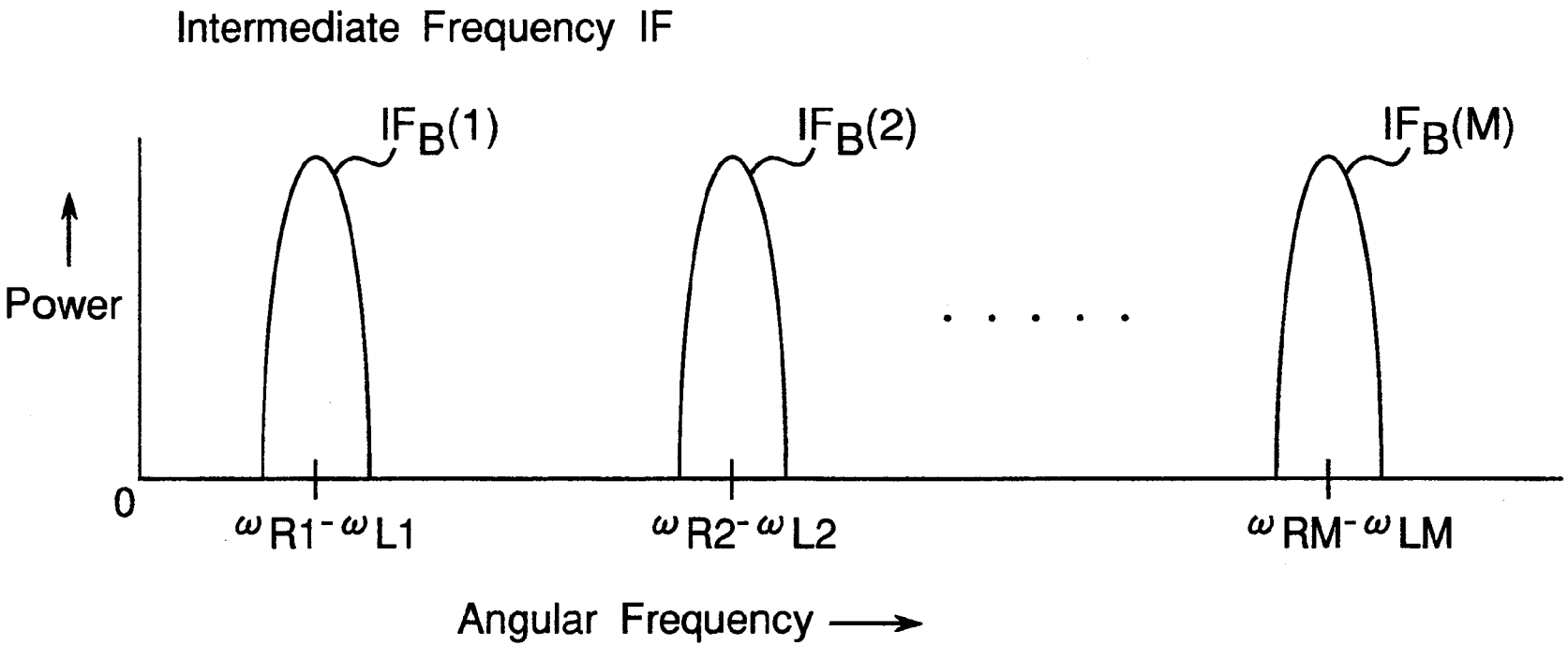
FIG. 7 is a graph showing intermediate frequency components included in an intermediate frequency signal IF outputted from a combiner 66 shown in FIG. 1.

(4) The combiner 66 combines a plurality of N inputted intermediate frequency signals $IF_A(n)$, and then, outputs an intermediate frequency signal IF of the combined result. In this case, the intermediate frequency signal IF includes a plurality of M intermediate frequency signals $IF_B(m)$ corresponding to the radio wave signals Rw(m) arriving at the array antenna 17 as shown in FIG. 7. The intermediate frequency signals $IF_B(m)$ are signals obtained through the combination of the plurality of N intermediate frequency signal components IF(m, n).

As described above, among the signals received by the array antenna 17, each signal whose phase inclination coincides with that of any of the reference signal components Rce(m, n) obtained through the inversion of the phases of the reference signal components Rce(m, n) is outputted from the combiner 66, while each signal of no phase coincidence is not substantially outputted. That is, only the desired radio wave signal Rw(m) is received out of the radio wave signals arriving at the array antenna 17, and the intermediate frequency signal $IF_B(m)$ corresponding to the radio wave signal Rw(m) is outputted.

Further, the following operations are executed in the stage of transmission.

(1) The optical signal processor 10 optically processes a plurality of M inputted transmitting signals T(m) so as to generate a plurality of N antenna radiation signals $T_A(n)$ corresponding to the antenna elements 17-n, and then, outputs the antenna radiation signals $T_A(n)$ to the transceiver module 60. In this case, the antenna radiation signals $T_A(n)$ are high-frequency signals which have been processed optically so that the transmitting signals T(m) are radiated with high-frequency beams B(m) formed in predetermined directions when the antenna radiation signals $T_A(n)$ are radiated from the corresponding antenna elements 17-n, and include a plurality of M transmitting signal components Te(m, n) corresponding to the respective transmitting signals T(m). Then, their transmitting signal components Te(m, 1) to Te(m, N) have phase inclinations corresponding to the directions in which the transmitting signals T(m) are transmitted.

(2) The transceiver module 60 amplifies the power of the inputted antenna radiation signals $T_A(n)$, and thereafter, outputs the resulting amplified signals to the corresponding antenna elements 17-n.

(3) The array antenna 17 radiates the inputted antenna radiation signals $T_A(n)$ from the corresponding antenna elements 17-n, so as to radiate the transmitting signals T(m) with the high-frequency beams B(m) formed in the predetermined directions.

The configuration of the optical control type phased array antenna apparatus of the first preferred embodiment will be described in detail below with reference to FIGS. 1 to 3. As shown in FIG. 1, in the present optical control type phased array antenna apparatus, a plurality of M high-frequency oscillators 4-m generate respective high-frequency signals So(m) each having a frequency lower by the intermediate frequency $f_{IF}(M)$ than that of the received signal R(n) received by the corresponding antenna element, and then, output the high-frequency signals So(m) to contacts "b" of switches SW1-m. In this case, each of a plurality of M switches SW1-m has a common terminal, a contact "a" and the contact "b". The common terminal is connected to the optical signal processor 10. Then switching between the contact "a" and the contact "b" is executed according to a switch control signal Csw from a transmission and reception switching controller 67 described later, so that the high-frequency signals So(m) or the transmitting signals T(m) are inputted as the input high-frequency signals S(m) to the optical signal processor 10. In this case, the transmitting signals T(m) are modulated by a predetermined modulation method such as PSK (Phase Shift Keying), QAM (Quadrature Amplitude Modulation) or the like according to a predetermined base-band signal. Further, the transmission and reception switching controller 67 controls the switches SW1-m so as to switch over between transmission and reception at predetermined time intervals.

Figure 2:
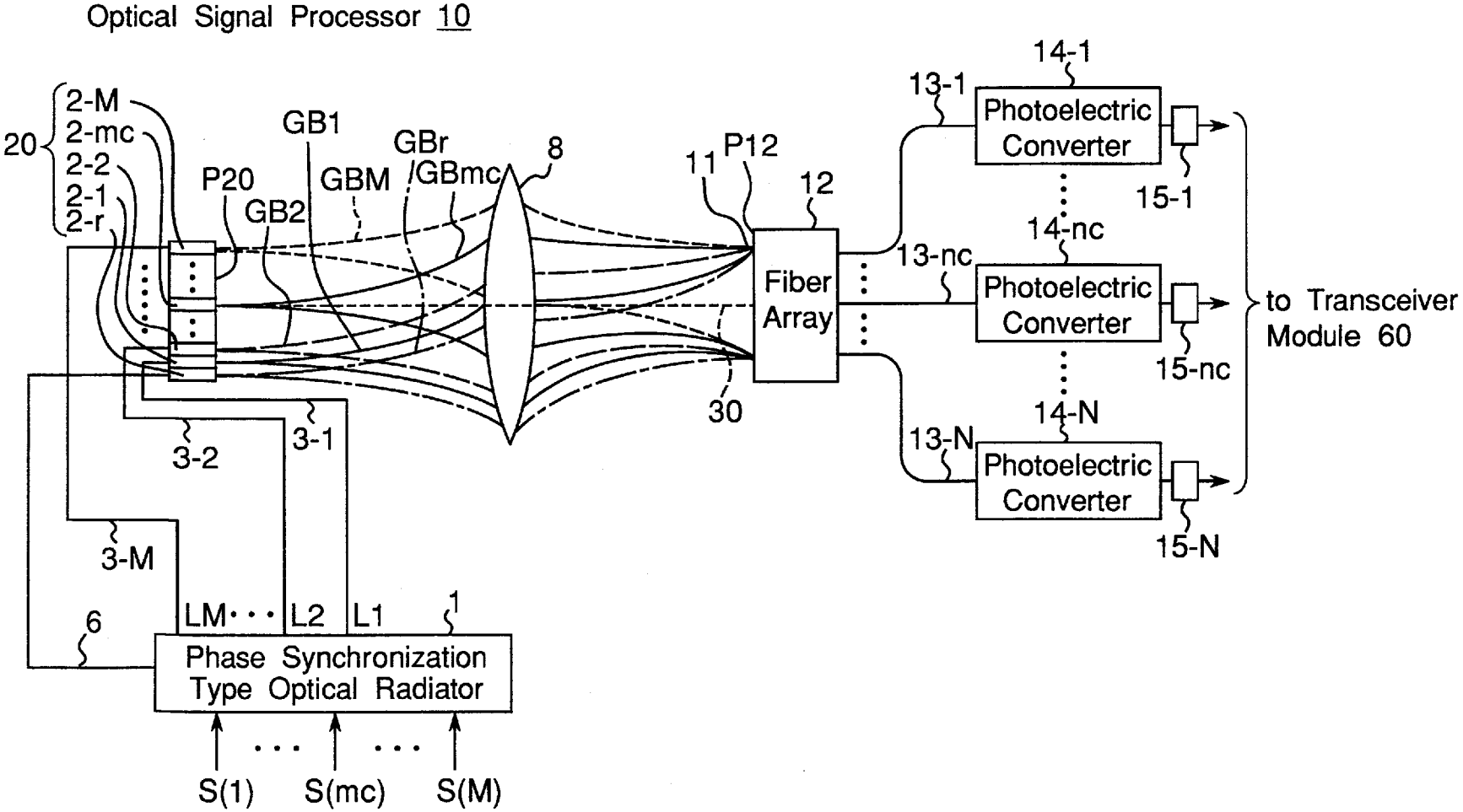
FIG. 2 is a block diagram showing a configuration of an optical signal processor 10 shown in FIG. 1.

Referring to FIG. 2, the optical signal processor 10 comprises the phase synchronization type optical radiator 1, the radiation lens array 20, the Fourier transformation lens 8, the fiber array 12, a plurality of N photoelectric converters 14-n, and a plurality of N band-pass filters 15-n. In the optical signal processor 10, input high-frequency signals S(1) to S(M) are inputted to the phase synchronization type optical radiator 1. The phase synchronization type optical radiator 1 outputs a reference beam of light having a predetermined frequency fo to the radiation lens array 20 via an optical fiber cable 6 as described in detail later, and also outputs a plurality of M beams of light L1 to LM whose frequencies are different from the frequency fo of the reference beam of light by the frequencies of a plurality of M input high-frequency signals S1 to SM inputted respectively, to the radiation lens array 20.

Figure 3:
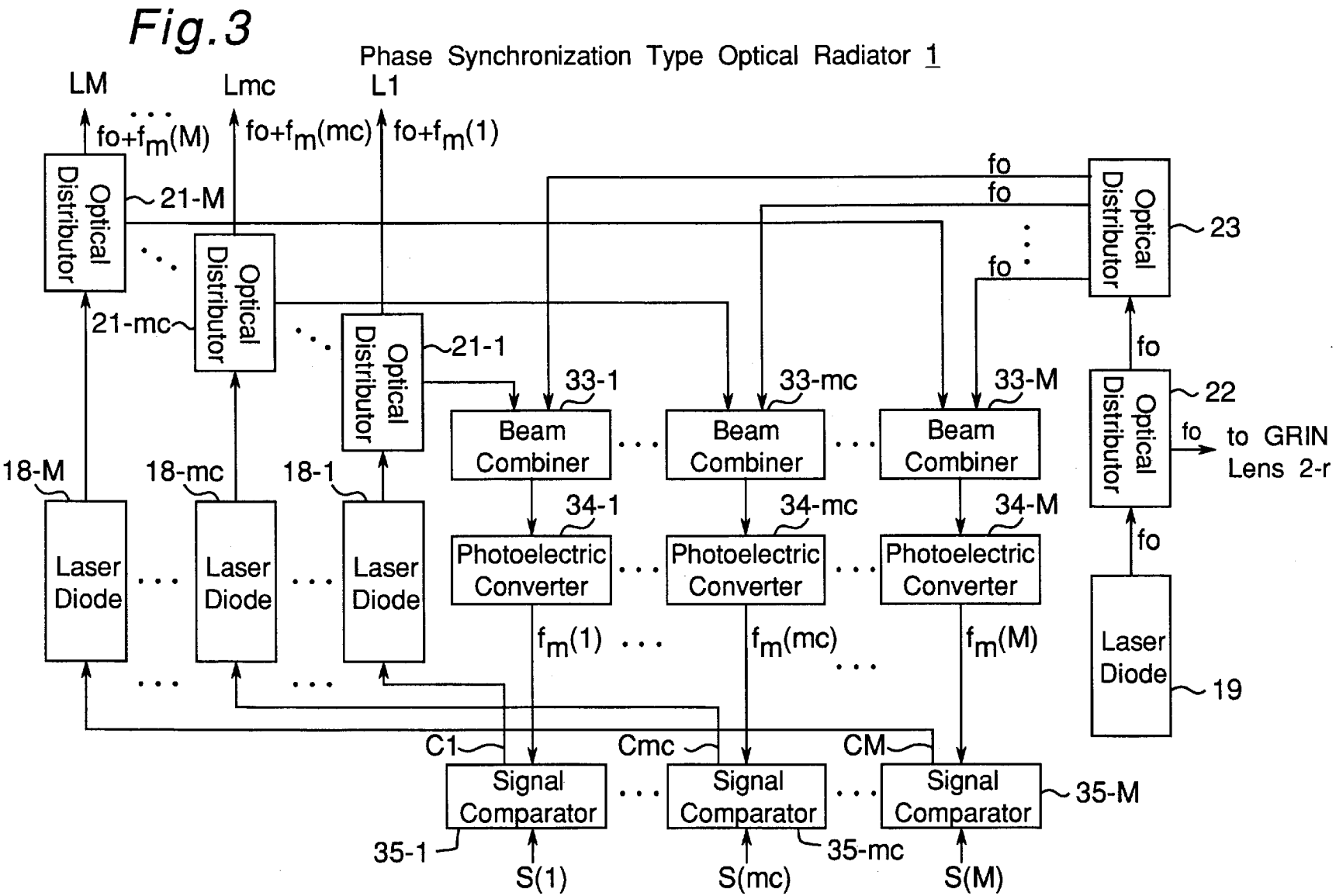
FIG. 3 is a block diagram showing a configuration of a phase synchronization type optical radiator 1 shown in FIG. 1.

In detail, referring to FIG. 3, the phase synchronization type optical radiator 1 is provided with laser diodes 18-1 to 18-M and 19, optical distributors 21-1 to 21-M, 22 and 23, beam combiners 33-1 to 33-M, photoelectric converters 34-1 to 34-M and signal comparators 35-1 to 35-M. In the phase synchronization type optical radiator 1, as shown in FIG. 3, the inputted high-frequency signals S(1) to S(M) are inputted to the signal comparators 35-1 to 35-M, respectively. Further, in the phase synchronization type optical radiator 1, each of the laser diode 18-m generates a beam of light having a predetermined frequency, and then, outputs the beam of light. The optical distributor 21-m comprises, for example, a beam splitter and operates to split the beam of light outputted from the laser diode 18-m into two branched beams of light, then outputs one branched beam of light as a beam of light Lm to the radiation lens array 20 connected to the phase synchronization type optical radiator 1, and also output another branched beam of light to the beam combiner 33-m.

On the other hand, the laser diode 19 generates a reference beam of light having a predetermined frequency fo, and then, outputs the same reference beam of light. The optical distributor 22 comprises, for example, a beam splitter and operates to split the reference beam of light outputted from the laser diode 19 into two branched beams of light, then output one branched reference beam of light as the reference beam of light to a GRIN lens 2-r via the optical fiber cable 6, and also output another branched reference beam of light to the optical distributor 23. The optical distributor 23 distributes another branched reference beam of light outputted from the optical distributor 22 into a plurality of M beams of light, and then, outputs the distributed branched reference beams of light to the beam combiners 33-1 to 33-M.

The beam combiner 33-m combines the branched reference beam of light inputted from the optical distributor 23 with the branched beam of light inputted from the optical distributor 21-m, and then, outputs the combined beam of light to the photoelectric converter 34-m. The photoelectric converter 34-m photoelectrically converts the inputted combined beam of light into a radio signal having a frequency of a difference between the branched beam of light and the branched reference beam of light and outputs the signal, to the signal comparator 35-m. The signal comparator 35-m compares the radio signal inputted from the photoelectric converter 34-m with the radio signal S(m) inputted via the SW1-m, and then, outputs an error voltage signal Cm proportional to the frequency difference between the two signals to the laser diode 18-m. In response to this error voltage signal Cm, an excitation current of the laser diode 18-m varies, then this leads to change in an oscillation frequency of the laser diode 18-m.

In the phase synchronization type optical radiator 1 constructed as above, the oscillation frequency of the laser diode 18-m is controlled so that the frequencies of the two radio signals inputted to the signal comparator 35-m coincide with each other. Therefore, a frequency difference between the frequency $fo+f_m(m)$ of the beam of light Lm outputted from the optical distributor 21-m and the frequency fo of the reference beam of light outputted from the optical distributor 22 is controlled so as to coincides with the frequency $f_m(m)$ of the input high-frequency signal S(m). In this case, the lengths of the optical fiber cables 3-1 to 3-M for transmitting each beam of light outputted from the phase synchronization type optical radiator 1 to the radiation lens array 20 are set equal to each other. With this arrangement, the amount of delay from the phase synchronization type optical radiator 1 to the radiation lens array 20 of the beams of light L1 to LM outputted from the phase synchronization type optical radiator 1 are set equal to each other.

Figure 4:
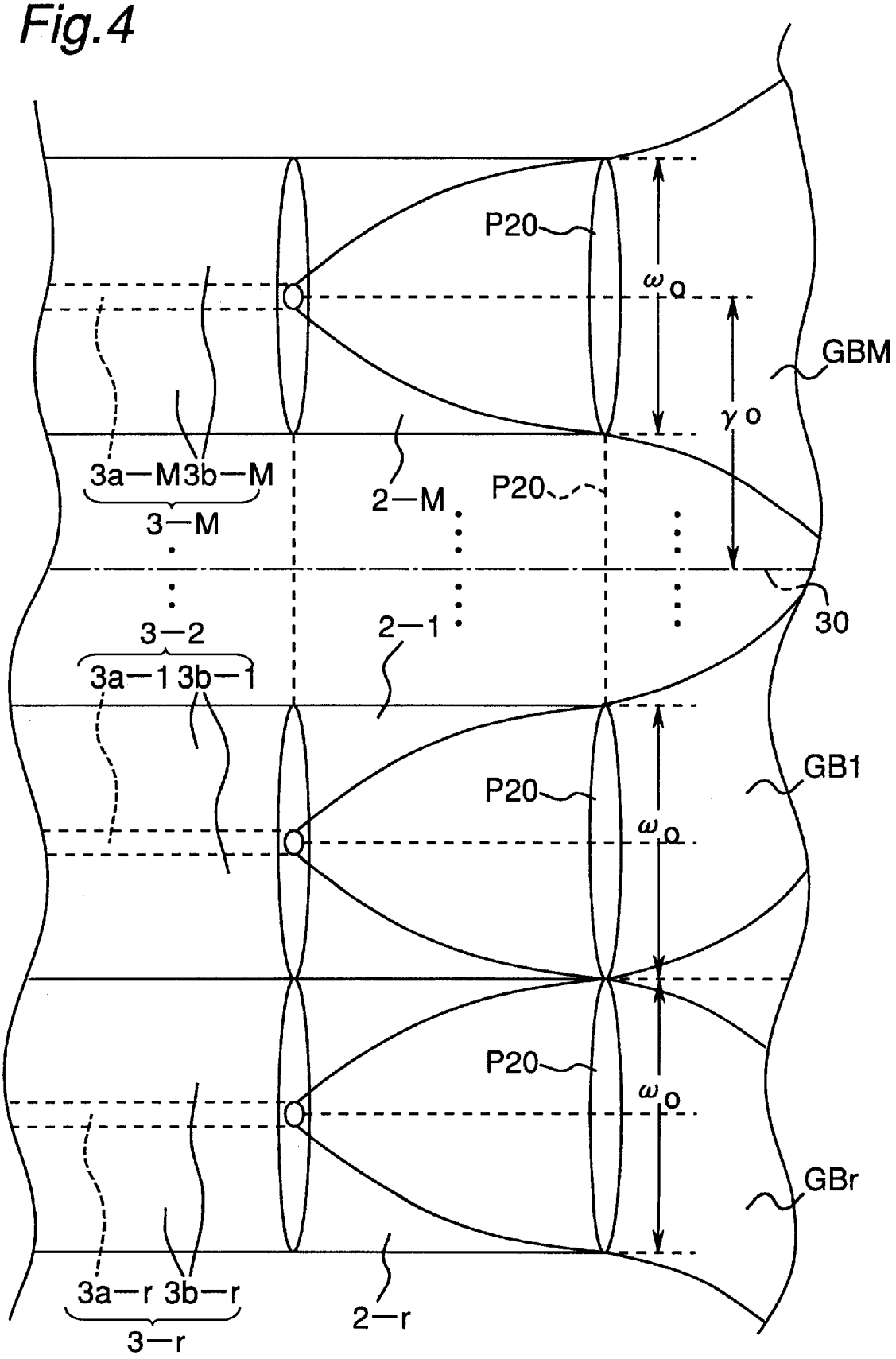
FIG. 4 is an enlarged perspective view showing a radiation lens ended fiber array 20 shown in FIG. 1.

Referring to FIG. 4, in the radiation lens array 20, a plurality of (M+1) gradient refractive index lenses (each referred to as a GRIN lens hereinafter in this specification) 2-1 to 2-M and 2-r are arranged in one-dimensional direction perpendicular to the optical axis 30 of the Fourier transformation lens 8 as described later. Then, the GRIN lenses 2-1 to 2-M expand the beam widths of the respective inputted beams of light L1 to LM to predetermined beam widths so that each beam diameter becomes $\omega_1$ on the input plane P12 as described later, and then, radiate them as Gaussian distribution beams of light GB1 to GBM to the Fourier transformation lens 8 so that the axes of the Gaussian distribution beams of light GB1 to GBM become parallel to one another. Furthermore, the GRIN lens 2-r expands the beam width of the inputted reference beam of light to a predetermined beam width so that the beam diameter becomes $\omega_1$ on the input plane P12, and then, radiates it as a Gaussian distribution beam of light GBr to the Fourier transformation lens 8 so that the axis of the Gaussian distribution beam of light GBr becomes parallel to the axes of the Gaussian distribution beams of light GB1 to GBM. In this case, the radiation lens array 20 is provided so that output planes of the GRIN lenses 2-1 to 2-M and 2-r coincide with one focal plane P20 of the Fourier transformation lens 8 and so that the optical axis of a GRIN lens 2-mc provided in the center of the radiation lens array 20 coincides with the optical axis 30. Further, the GRIN lenses 2-1 to 2-M and 2-r are cylindrical lenses each having a distribution such that the refractive index continuously varies in the radial direction, and the diameter of the circular output plane is the beam waist diameter $\omega_0$ of the Gaussian distribution beam to be radiated. The optical fiber cables 3-1 to 3-M and 3-r comprises cores 3*a*-1 to 3*a*-M and 3*a*-r and claddings 3*b*-1 to 3*b*-M and 3*b*-r, respectively, and they are connected so that the axes of the cores 3*a*-1 to 3*a*-M and 3*a*-r coincide with the optical axes of the GRIN lenses 2-1 to 2-M and 2-r.

Referring to FIG. 2, the Fourier transformation lens 8 converges the plurality of (M+1) Gaussian distribution beams of light GB1 to GBM and GBr radiated from the radiation lens array 20 so that they overlap one another on the other focal plane of the Fourier transformation lens 8, and makes a combined beam of light 11 formed by converging and combining the Gaussian distribution beams of light GB1 to GBM and GBr incident on the fiber array 12. By this operation, the Gaussian distribution beams of light GB1 to GBM are subjected to spatial Fourier transformation, so that they are transformed into a Fourier transformation beam of light having a phase inclination corresponding to the radiating positions of the Gaussian distribution beams of light GB1 to GBM. Therefore, the combined beam of light 11 includes a plurality of M Fourier transformation beams of light and the reference beam of light. It is to be noted that the Fourier transformation lens is disclosed, for example, in a prior art document of T. Ohgoshi, "Optoelectronics", The Institute of Electronics, Information and Communication Engineers in Japan, The Institute of Electronics, The Information and Communication Engineers University Series, F-10, page 55–58, Aug. 15, 1982.

The fiber array 12 comprises a plurality of N sampling optical fibers 12-1 to 12-N and is arranged so that the input plane P12 of the fiber array 12 is positioned on the other focal plane of the Fourier transformation lens 8.

Figure 5:
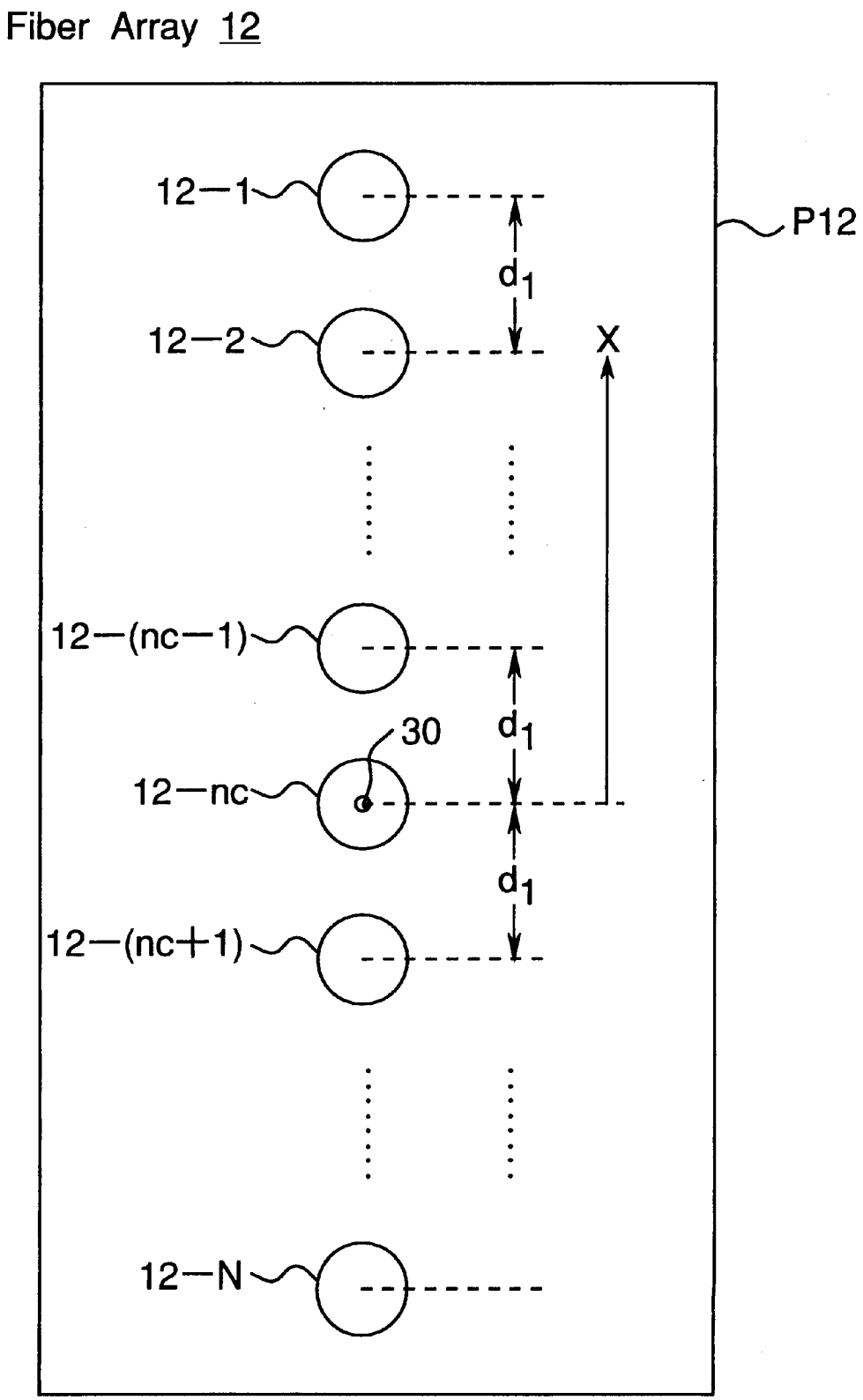
FIG. 5 is a plan view of an input plane P12 of a fiber array 12.

Referring to FIG. 5, the sampling optical fibers 12-1 to 12-N are arranged at predetermined intervals $d_1$ on a straight line so that the axes of the sampling optical fibers 12-1 to 12-N are parallel to one another and so that the detection surfaces of the sampling optical fibers 12-1 to 12-N are positioned on the input plane P12. Then, the fiber array 12 is arranged so that the axis of a sampling optical fiber 12-nc located in the center coincides with the optical axis 30 and so that the direction of arrangement of the sampling optical fibers 12-1 to 12-N becomes parallel to and coincides with the direction of arrangement of the GRIN lenses 2-1 to 2-M of the radiation lens array 20.

With this arrangement, the fiber array 12 spatially samples the incident combined beam of light 11 on the input plane P12 of the fiber array 12 by the detection surfaces of the sampling optical fibers 12-1 to 12-N, and then, outputs the sampled beams of light to the photoelectric converters 14-1 to 14-N via optical fiber cables 13-1 to 13-N, respectively. In this case, the sampled beams of light comprises a plurality of M spatially sampled Fourier transformation beams of light and a spatially sampled reference beam of light.

The photoelectric converters 14-1 to 14-N photoelectrically convert the respective inputted sampled beams of light into optically processed signals TR(n) comprising a plurality of M radio signal components which have frequencies varied by the frequencies of the plurality of M Fourier transformation beams of light from the frequency fo of the reference beam of light and are proportional to the amplitudes of the Fourier transformation beams of light and whose phases coincide with the Fourier transformation beams of light, and thereafter, output the optically processed signals TR(n) to the transceiver module 60 via the respective band-pass filters 15-n. In this case, the optically processed signals TR(n) in the stage of reception correspond to the reference signals Rc(n), and the above-mentioned plurality of M radio signal components correspond to the reference signal components Rce(m, n). In the stage of transmission, the optically processed signals TR(n) correspond to the antenna radiation signals $T_A(n)$, and the above-mentioned plurality of M radio signal components correspond to the transmitting signal components Te (m, n). Further, the band-pass filters 15-1 to 15-N are constructed so that they allow the reference signals Rc(n) and the antenna radiation signals $T_A(n)$ to pass therethrough.

Referring to FIG. 1, the transceiver module 60 is constructed of a combination of circuits comprising a phase inverter 61-n, a power amplifier 62-n, a mixer 63-n and a pair of switches SW2-n and SW3-n each having a common terminal, a contact "a" and a contact "b", for each antenna element 17-n. That is, to the common terminal of the switch SW2-n is inputted the optically processed signal TR(n) from the optical signal processor 10, and the antenna elements 17-n is connected to the common terminal of the switch SW3-n. The power amplifier 62-n is connected between the contact "a" of the switch SW2-n and the contact "a" of the switch SW3-n, and the phase inverter 61-n and the mixer 63-n are serially connected between the contact "b" of the switch SW2-n and the contact "b" of the switch SW3-n. This phase inverter 61-n inverts the phase of the reference signal Rc(n) inputted as the optically processed signal TR(n), and then, outputs the resulting signal to the mixer 63-n. In this case, each of the switches SW2-n and SW3-n is switched over to the contact "a" in the stage of transmission and to the contact "b" in the stage of reception by the transmission and reception switching controller 67.

Further, the intermediate frequency signals $IF_A(n)$ outputted from the mixers 63-n of the transceiver module 60 are inputted to the combiner 66 via band-pass filters 64-n and intermediate frequency signal amplifiers 65-n. In this case, each mixer 63-n has a nonlinear input-to-output characteristic of the second or higher order, and then, outputs various kinds of signals each including a signal having the frequency of the difference between the inputted reference signal Rc(n) and the received signal R(n). Each band-pass filter 64-n allows only the signal having the frequency of the difference between the reference signal Rc(n) and the received signal R(n) out of the signals outputted from the mixer 63-n to pass the same therethrough or band-pass-filtering the same, and then, outputs the passed signal. That is, the mixer 63-n and the band-pass filter 64-n constitute a frequency converting means. Then, the combiner 66 combines a plurality of N inputted intermediate frequency signals $IF_A(1)$ to $IF_A(N)$, and then, outputs the intermediate frequency signal IF of the combined result obtained through the combining to a demodulator 68. Each of the demodulator 68 demodulates base-band signal included in each radio wave signal Rw(m) from the inputted intermediate frequency signal IF, and then, outputs the demodulated signal.

In the optical control type phased array antenna apparatus of the first preferred embodiment constructed as above, each of the switches SW1-m, SW2-n and SW3-n is switched over to the contact "b" by the transmission and reception switching controller 67 in the stage of reception. By this operation, each high-frequency signal So(m) is inputted to the optical signal processor 10, and then, the reference signal Rc(n) is generated based on the signal So(m), and is inputted to the mixer 63-n via the switch SW2-n and the phase inverter 61-n. On the other hand, each received signal R(n) received by each antenna element 17-n is inputted to the mixer 63-n via the switch SW3-n. The received signal R(n) and the reference signal Rc(n) inputted to the mixer 63-n are mixed with each other. The intermediate frequency signals $IF_A(n)$ of the mixed result obtained through the mixing are inputted to the combiner 66 via the band-pass filter 64-n and the intermediate frequency signal amplifier 65-n, and then, the combiner 66 combines the inputted signals and also the demodulator 68 demodulates the same signals, thereafter, a demodulated signal is outputted.

In the stage of transmission, each of the switches SW1-m, SW2-n and SW3-n is switched over to the contact "a" by the transmission and reception switching controller 67. By this operation, each transmitting signal T(m) is inputted to the optical signal processor 10, and then, the antenna radiation signal $T_A(n)$ is generated based on the transmitting signal T(m) and is inputted to the phase inverter 61-n via the switch SW2-n. Then, the antenna radiation signal $T_A(n)$ whose phase is inverted is radiated from the antenna element 17-n to a free space via the mixer 63-n and the switch SW3-n, and the antenna radiation signal $T_A(n)$ radiated from each antenna element is transmitted with a high-frequency beam corresponding to the transmitting signal T(m) formed in a predetermined direction.

Next, the theory of generating the reference signal Rc(n) and the antenna radiation signal $T_A(n)$ having a predetermined phase inclination corresponding to the direction in which each radio wave signal Rw(m) comes and the direction in which the high-frequency beam B(m) is formed by the optical signal processor 10 constructed as above will be described.

Figure 6:
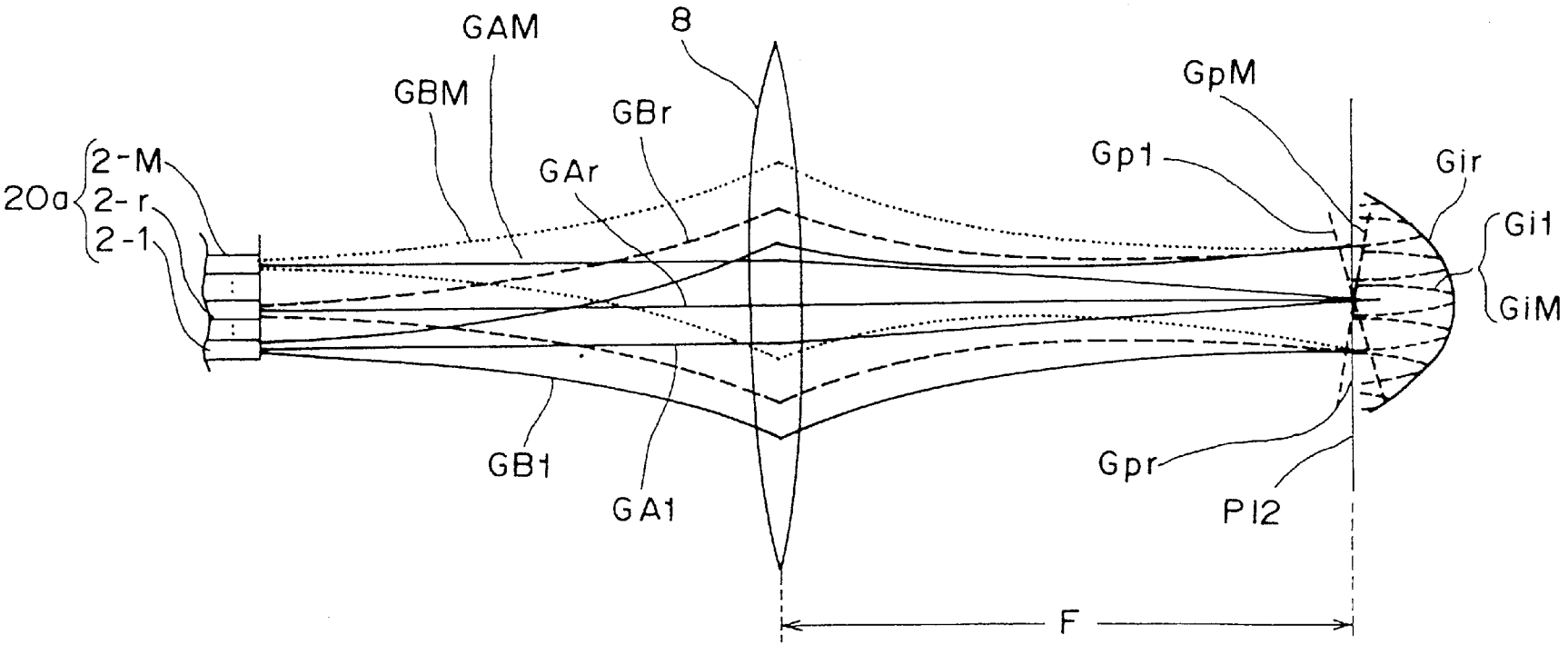
FIG. 6 is a viewgraph for explaining the processing in an optical system comprising a radiation lens array 20, a Fourier transformation lens 8 and a fiber array 12 of the first preferred embodiment shown in FIG. 1.

FIG. 6 shows a state in which a Gaussian distribution beam of light GBk radiated from the radiation lens array 20 is converged on the focal plane P12 of the fiber array 12 by the Fourier transformation lens 8 in correspondence with the plurality of M input high-frequency signals S(1) to S(M) inputted to the optical signal processor 10. For simplicity of illustration, FIG. 6 shows a radiation lens array 20*a* in which the GRIN lens 2-r for radiating the reference Gaussian distribution beam of light GBr is provided in the center in a case where Gaussian distribution beams of light GB1, GBr and GBM are radiated from the three GRIN lenses 2-1, 2-r and 2-M. The GRIN lenses 2-1, 2-r and 2-M are arranged so that the axes GA1, GAr and GAM of the GRIN lenses 2-1, 2-r and 2-M are parallel to the axis of the Fourier transformation lens 8. Therefore, the Gaussian distribution beams of light GB1, GBr and GBM radiated from the GRIN lenses 2-1, 2-r and 2-M are radiated so that the axes GA1, GAr and GAM of the beams are parallel to each other and made incident on the Fourier transformation lens 8.

Therefore, the Gaussian distribution beams of light GB1, GBr and GBM incident on the Fourier transformation lens 8 are converged so that the axes of the Gaussian distribution beams of light GB1, GBr and GBM coincide with one another on the input plane P12 that is the other focal plane of the Fourier transformation lens 8, so as to form interference fringes on the input plane P12. In this case, each of the Gaussian distribution beams of light GB1, GBr and GBM has a beam diameter $\omega_1$ expressed by the equation (7) described later on the input plane P12. Therefore, the interference fringes are formed in the beam convergence portion of the diameter $\omega_1$ about the optical axis 30 on the input plane P12.

In FIG. 6, straight lines denoted by Gp1, Gpr and GpM show the phase inclinations of the Gaussian distribution beams of light GB1, GBr and GBM on the input plane P12. The phase inclinations will be described later with reference to FIG. 11.

Next, the interference fringes formed by the Gaussian distribution beam of light GBm (m is 1 or M) that has been frequency-modulated by an input high-frequency signal having a frequency fm and the reference Gaussian distribution beam of light GBr will be described. It is assumed now that the Gaussian distribution beam of light GBm is radiated from a position located apart by a distance ro from the optical axis 30 and the Gaussian distribution beam of light GEr is radiated from the GRIN lens 2-r on the optical axis 30. Electric field vectors Er and Em excited at positions located apart by a distance x from the optical axis 30 on the input plane P12 by the Gaussian distribution beam of light GBr and the Gaussian distribution beam of light GEm are expressed by the following equations (1) and (2). In this case, in order to process the input high-frequency signal stably and efficiently by means of a beam of light in the optical control type phased array antenna apparatus of the first preferred embodiment, two beams of light incident on the input plane P12 at different incident angles are set so that they have an identical plane of polarization. Therefore, the electric field vectors $E_r$ and $E_m$ have an identical vertical direction with respect to the optical axis 30.

$$E_r=A_r\exp(j.2\pi.fo.t) \quad (1)$$

$$E_m=A_m\exp(j.2\pi.f1.t+j.k.x.\sin\theta) \quad (2)$$

In this case, the incident angle θ is the angle between the direction of incidence of the Gaussian distribution beam of light GBm and the optical axis 30, and k is a wavelength constant expressed by $k=2\pi/\lambda$ by means of the wavelength λ of the Gaussian distribution beam of light GBm. Therefore, a total electric vector $E_T$ at a position located apart by a distance x from the optical axis 30 on the input plane P12 can be expressed by the following equation (3) as a sum of the electric vector $E_r$ expressed by the equation (1) and the electric vector $E_m$ expressed by the equation (2), and the intensity of light of the interference fringes at the position can be expressed by the following equation (4) by means of the electric vector $E_T$ and a conjugate vector $E_T^*$ of the electric vector $E_T$.

$$\begin{aligned} E_T &= E_m + E_r \\ &= A_m\exp(j\cdot 2\pi\cdot fo\cdot t) + A_r\exp(j\cdot 2\pi\cdot f1\cdot t + j\cdot k\cdot x\cdot\sin\theta) \end{aligned} \quad (3)$$

$$\begin{aligned} I &= E_T\cdot E_T^* \\ &= \{A_m\exp(j\cdot 2\pi\cdot fo\cdot t) + A_r\exp(j\cdot 2\pi\cdot f1\cdot t + j\cdot k\cdot x\cdot\sin\theta)\}\times \\ &\quad \{A_m\exp(-j\cdot 2\pi\cdot fo\cdot t) + A_r\exp(-j\cdot 2\pi\cdot f1\cdot t - \\ &\quad j\cdot k\cdot x\cdot\sin\theta)\} \\ &= 2A_m\cdot A_r + 2A_m\cdot A_r\cos\{(2\pi\cdot f_m\cdot t + 2\pi\cdot ro\cdot x/(\lambda\cdot F)\} \end{aligned} \quad (4)$$

In the above-mentioned equations, f1 is the frequency of the Gaussian distribution beam of light GBm, ro is the distance from the axis of the GRIN lens that radiates the Gaussian distribution beam of light GBm to the optical axis 30, and fo is the frequency of the Gaussian distribution beam of light GBr. That is, there is the relation of the input high-frequency signal frequency $f_m$=f1−fo. Further, λ is the wavelength of the reference Gaussian distribution beam of light GBr, and F is the focal distance of the Fourier transformation lens 8, where the wavelength λ and the focal distance F are constants. As is apparent from the equation (4), the intensity I changes to oscillates with a sine waveform at a frequency equal to the frequency $f_m$ of the input high-frequency signal. Therefore, when the mixed optical signal is inputted to the photoelectric converter, the photoelectric converter can generate a radio signal having an amplitude proportional to $A_mA_r$ and the frequency $f_m$.

In this case, the amplitude on the sectional surface of the Gaussian distribution beam of light radiated from the GRIN lens generally has a Gaussian distribution. Furthermore, an ideal lens only changes the beam size and does not change the beam mode, and therefore, the Gaussian distribution beam of light propagated via the Fourier transformation lens 8 retains the Gaussian mode thereof. Therefore, the Gaussian distribution beam of light GBm and the Gaussian distribution beam of light GBr also have Gaussian distributions on the input plane P12. Therefore, the amplitudes $A_m$ and $A_r$ in the equations (1) and (2) can be expressed by the following equations (5) and (6), respectively. In this case, the diameter $\omega_1$ of the beam convergence portion on the input plane P12 can be expressed by the equation (7).

$$A_m=A_{m0}\exp(-x^2/\omega_1^2) \quad (5)$$

$$A_r=A_{r0}\exp(-x^2/_1^2) \quad (6)$$

$$\omega_1=\lambda F/(\pi\omega_0) \quad (7)$$

In this case, $\omega_0$ is the beam waist of the Gaussian distribution beams of light GBm and GBr, and F is the focal distance of the Fourier transformation lens 8. When the distance ro from the axis of the GRIN lens that radiates the Gaussian distribution beam of light GBm to the optical axis 30 is much shorter than the focal distance F of the Fourier transformation lens 8, the expression of $\sin\theta=ro/F\approx\theta$ can hold. Therefore, an optical excitation intensity distribution by interference light on the input plane P12 is expressed as a function of a position x as denoted by Gir, Gil and GiM in FIG. 6. Its detail will be described later with reference to the graph shown in FIG. 12. In FIG. 6, the pattern denoted by Gir shows an unchanged or fixed Gaussian distribution, and the dotted lines denoted by Gi1 and GiM within the fixed Gaussian distribution Gir indicate an optical excitation intensity distribution which oscillates with a sine waveform.

In the first preferred embodiment, the above-mentioned optical excitation intensity distribution that oscillates with a sine waveform is spatially sampled on the input plane P12. Therefore, in order to detect a radio signal corresponding to the optical excitation intensity that oscillates with a sine waveform, the sampling interval is preferably set so that at least one sampling optical fiber 12-m is positioned between adjacent nulls of the interference fringes expressed by the equation (4). For the above-mentioned reasons, we set the interval $d_1$ of the adjacent sampling optical fibers 12-m so that the equation (8) is satisfied. Therefore, the maximum number $M_{max}$ of beams which can be formed by the optical signal processor 10 can be expressed by the equation (9).

$$d_1.ro/F\leq\lambda/2 \quad (8)$$

$$M_{max}=\lambda F/(do.d_1) \quad (9)$$

In the above-mentioned equations, do is the interval between adjacent GRIN lenses. Next, when using the known shift theory concerning a focusing lens that a spatial radiating position of a Gaussian distribution beam of light on the focal plane on one side causes a linear phase change with respect to the distance x on the focal plane on the other side, the optical excitation intensity distribution that is the electric field induced on the input plane P12 in correspondence with the interference fringes formed as a consequence of the mixture of the Gaussian distribution beam of light GBr with an arbitrary Gaussian distribution beam of light GBm can be expressed by the following equation (10).

$$E_0(x) = A_{m0}A_{r0}\exp(-2x^2/\omega_1^2)\cdot\exp\{j\cdot 2\pi\cdot x\cdot ro/(\lambda\cdot F)\} \quad (10)$$

In this case, the equation (10) can be also derived from the equation (4). The imaginary part of the equation (10) relates to an instantaneous value of the interference fringes that vary in accordance with the time at a frequency equal to a frequency difference between the two beams of light. Further, about 95% of the mixture beam is concentrated on the beam convergence portion of the diameter $\omega_1$, and therefore, the number N of the sampling optical fibers 12-n, i.e., the number N of the antenna elements is determined according to the following equation (11).

$$N=2\omega_1/d_1=2\lambda.F/(\pi.d_1.\omega_0) \quad (11)$$

As described in detail above, the interference fringes formed on the input plane P12 has an intensity and a phase corresponding to the radiating position ro of the Gaussian distribution beam of light and the position x of the sampling optical fiber on the input plane P12 as expressed in the equations (4) and (10) and oscillate at the frequency fm. That is, as is evident from the equation (4), the interference fringes have a phase proportional to the position x and oscillate at the frequency fm, and the coefficient of proportion of the phase is proportional to the radiating position ro. Therefore, by sampling and photoelectrically converting the intensity of the above-mentioned oscillating interference fringes, a high-frequency signal which has the intensity and phase corresponding to the radiating position ro of the Gaussian distribution beam of light and the position x of the sampling optical fiber as well as the frequency fm can be generated. The above is the basic operation of the optical signal processor 10.

Next, based on the basic operation of the above-mentioned optical signal processor 10, the receiving operation of the optical control type phased array antenna apparatus of the present preferred embodiment will be described and subsequently the transmitting operation of the array antenna apparatus will be described.

First of all, the received signal components Re(m, n) received at each antenna element 17-n in response to the radio wave signal Rw(m) coming in a predetermined direction can be expressed by the following equation (12). The reference signal components Rce(m, n) included in the reference signal Rc(n) that has been generated in the optical signal processor 10 based on the input high-frequency signal S(m) inputted in correspondence with the received signal components Re(m, n) and inverted in phase can be expressed by the following equation (13).

$$E_{Rmn}=A\exp(-j\omega_{Rm}t-jn\beta_m) \tag{12}$$

$$E_{Lmn}=B\exp(-j\omega_{Lm}t-jn\alpha_m) \tag{13}$$

In this case, $\omega_{Rm}$ of the equation (12) is an angular frequency of the radio wave signal Rw(m), and $\beta_m$ is a phase difference obtained when radio wave signals Rw(m) are received at adjacent antenna elements. Further, $\omega_{Lm}$ of the equation (13) is an angular frequency of the input high-frequency signal S(m), and $\alpha_m$ is a phase difference between reference signal components corresponding to the input high-frequency signal S(m) obtained by photoelectrically converting the sampled beams of light sampled by adjacent sampling fibers.

Therefore, intermediate frequency signal components $IF_A$ (m, n) outputted by mixing the received signal components Re(m, n) with the reference signal components Rce(m, n) can be expressed by the following equation (14). An intermediate frequency signal $IF_B$(m) that is the sum total of the intermediate frequency signal components IF(m, n) received by each antenna element 17-n in correspondence with the high-frequency beam B(m) can be expressed by the following equation (15).

$$E_{IFmn} = AB\exp\{-j(\omega_{Rm}-\omega_{Lm})t - jn(\alpha_m-\beta_m)\} \tag{14}$$

$$\begin{aligned} E_{IFm} &= AB\exp\{-j\omega_{IFm}t)\sum_{n=0}^{N-1}\exp\{-jn(\alpha_m-\beta_m)\} \\ &= AB\exp\{-j\omega_{IFm}t)\{1-\exp\{-jN\sigma_m)\}\{1-\exp\{-jN\sigma_m)\} \\ &= AB\exp\{-j\omega_{IFm}t - j(N-1)\sigma_m/2\}\cdot\sin(N\sigma_m/2)/\sin(\sigma_m/2) \end{aligned} \tag{15}$$

where $\omega_{IFm}=\omega_{Rm}-\omega_{Lm}$ and $\sigma_m=\alpha_m-\beta_m$. Further, sin $(N\sigma_m/2)$/ sin $(\sigma_m/2)$ in the equation (15) takes its maximum value N when $\sigma_m$=q.2r (q=0, 1, 2, . . . ). Further, taking into consideration only a case where the interval between the antenna elements is smaller than the half-wavelength, there is no case where q≧1. Therefore, sin $(N\sigma_m/2)$/ sin $(\sigma_m/2)$ takes its maximum value N when am =0. The present preferred embodiment is constructed so that the position x and the interval $d_1$ of the sampling optical fiber 12-n and the radiating position of the Gaussian distribution beam of light GBm are set in correspondence with the direction in which the radio wave signal Rw(m) comes so as to receive the radio wave signal Rw(m) coming in a predetermined direction and output the intermediate frequency signal IF(m) corresponding to the radio wave signal Rw(m).

Likewise, in the stage of transmission, by transmitting the antenna radiation signal $T_A$(n) having a predetermined phase inclination corresponding to the position x and interval $d_1$ of the sampling optical fiber 12-n and the radiating position ro of the Gaussian distribution beam of light GBm from the corresponding antenna element 17-n by means of the optical signal processor 10, the transmission is executed with the high-frequency beam B(m) formed in the predetermined direction. In this case, each reference signal Rc(n) is inverted in phase by means of the phase inverter 61-n in the present preferred embodiment. This arrangement is adopted for the formation of the high-frequency beam B(m) of the transmitting signal T(m) in the direction of the incoming radio wave signal Rw(m). The present invention is not limited to this, and the direction in which the radio wave signal Rw(m) comes and the direction in which the high-frequency beam B(m) of the transmitting signal T(m) is formed may be made to coincide with each other by inverting the phase of the antenna radiation signal $T_A$(n).

Furthermore, the instantaneous pattern of the interference fringes detected by the fiber array 12 is averaged in time as a Gaussian distribution by the photoelectric converters 14-1 to 14-N, and therefore, a far-field radiation pattern of the high-frequency beam B(m) formed by radiating the antenna radiation signal $T_A$(n) from the antenna element 17-n can be expressed by the following equation (16) based on the equation (10).

$$E_R(\theta) = \sum_{m=-N/2}^{N/2} A_{m0}A_{r0}\exp(-2m^2d_1^2/\omega_1^2)\cdot \exp(j\cdot m\cdot k\cdot(d_m\cos\theta - d_1\cdot ro/F) \tag{16}$$

where $d_m$ is the interval between adjacent elements of the array antenna 17. That is, according to the above-mentioned theory, the beam expressed by the equation (16) in correspondence with the distance ro from the optical axis 30 at the position at which the Gaussian distribution beam of light GBm is radiated can be formed in a predetermined direction.

That is, in the stage of transmission, the Gaussian distribution beam of light GBm that is radiated from a GRIN lens 2-m and incident on the Fourier transformation lens 8 in the optical control type phased array antenna apparatus shown in FIG. 1 is once subjected to Fourier transformation by the Fourier transformation lens 8 to become a Fourier transformation image of the Gaussian distribution beam of light GBm (i.e., Fraunhofer diffraction image) on the input plane P12, and the Fourier transformation image is spatially sampled by the fiber array 12. Subsequently, when it is transmitted from the array antenna apparatus comprising the antenna elements 17-1 to 17-N, the radiation pattern of the array antenna 17 becomes a Fourier transformation image (i.e., Fraunhofer diffraction image) of an amplitude phase distribution at the aperture of the array antenna 17. That is, the amplitude phase distribution of the Gaussian distribution beam of light GBm incident on the Fourier transformation lens 8 is subjected to Fourier transformation twice. Therefore, for known reasons, the amplitude phase distribution of the Gaussian distribution beam of light GBm incident on the Fourier transformation lens 8 uniquely corresponds to the amplitude phase distribution of the far-field radio signal Sm radiated from an array antenna.

In this case, the amplitude phase distribution of the Gaussian distribution beam of light GBm incident on the Fourier transformation lens 8 uniquely corresponds to the distance ro of the GRIN lens 2-m that radiates the Gaussian distribution beam of light GBk from the optical axis 30. With this arrangement, the radiation beam of the radio signal Sm radiated from the array antenna 17 in correspondence with the Gaussian distribution beam of light GBm radiated from the GRIN lens 2-m is radiated in a predetermined radiating direction (shown on the right-hand side in FIG. 1) corresponding to the distance ro of the GRIN lens 2-m from the optical axis 30.

As shown in FIG. 1, a high-frequency beam B(mc) of a transmitting signal T(mc) radiated from the array antenna 17 in correspondence with the Gaussian distribution beam of light GBm radiated from the GRIN lens 2-m positioned in the center of the radiation lens array 20 has a vertical radiating direction with respect to the radiation plane of the array antenna 17. High-frequency beams B(1) and B(mc) corresponding to transmitting signals T(1) and T(M) radiated from the array antenna 17 in correspondence with a Gaussian distribution beam of light GB1 and the Gaussian distribution beam of light GBM radiated from the GRIN lens 2-1 and the GRIN lens 2-M positioned farthest away from the optical axis 30 in the radiation lens array 20 have the greatest angle of radiation with respect to the vertical direction of the radiation plane of the array antenna 17.

As described in detail above, the optical control type phased array antenna apparatus of the first preferred embodiment is provided with the optical signal processor 10 to generate the reference signal Rc(n) for reception including the plurality of M reference signal components Rce(m, n) and generate each antenna radiation signal $T_A(n)$ for transmission including the plurality of M transmitting signal components Te(m, n). Therefore, the plurality of M radio wave signals Rw(m) coming in the respective predetermined directions can be received, and high-frequency beams can be generated in the respective directions, thereby allowing the plurality of M transmitting signals T(m) to be transmitted.

Furthermore, the optical control type phased array antenna apparatus of the first preferred embodiment is provided with the optical signal processor 10 and executes the transmission and received signal processing operations without executing any digital signal processing. Therefore, the signal processing operations can be executed simply at a high speed.

Furthermore, the above-mentioned optical control type phased array antenna apparatus of the first preferred embodiment is provided with the radiation lens array 20 which radiates the Gaussian distribution beams of light GB1 to GBM and the reference Gaussian distribution beam of light GBr on an identical plane. Therefore, it can be constructed with neither beam combiner nor distribution adjuster, so that it is allowed to have a simpler alignment adjustment, smaller loss and compact size further than those of the prior arts.

The optical control type phased array antenna apparatus of the first preferred embodiment switches between transmission and reception by means of the switches SW2-n and SW3-n in the transceiver module 60. Therefore, it can be operated even when the frequency of the radio wave signal Rw(m) and the frequency the transmitting signal T(m) to be transmitted in correspondence with the radio wave signal are equal to each other.

SECOND PREFERRED EMBODIMENT

Figure 8:
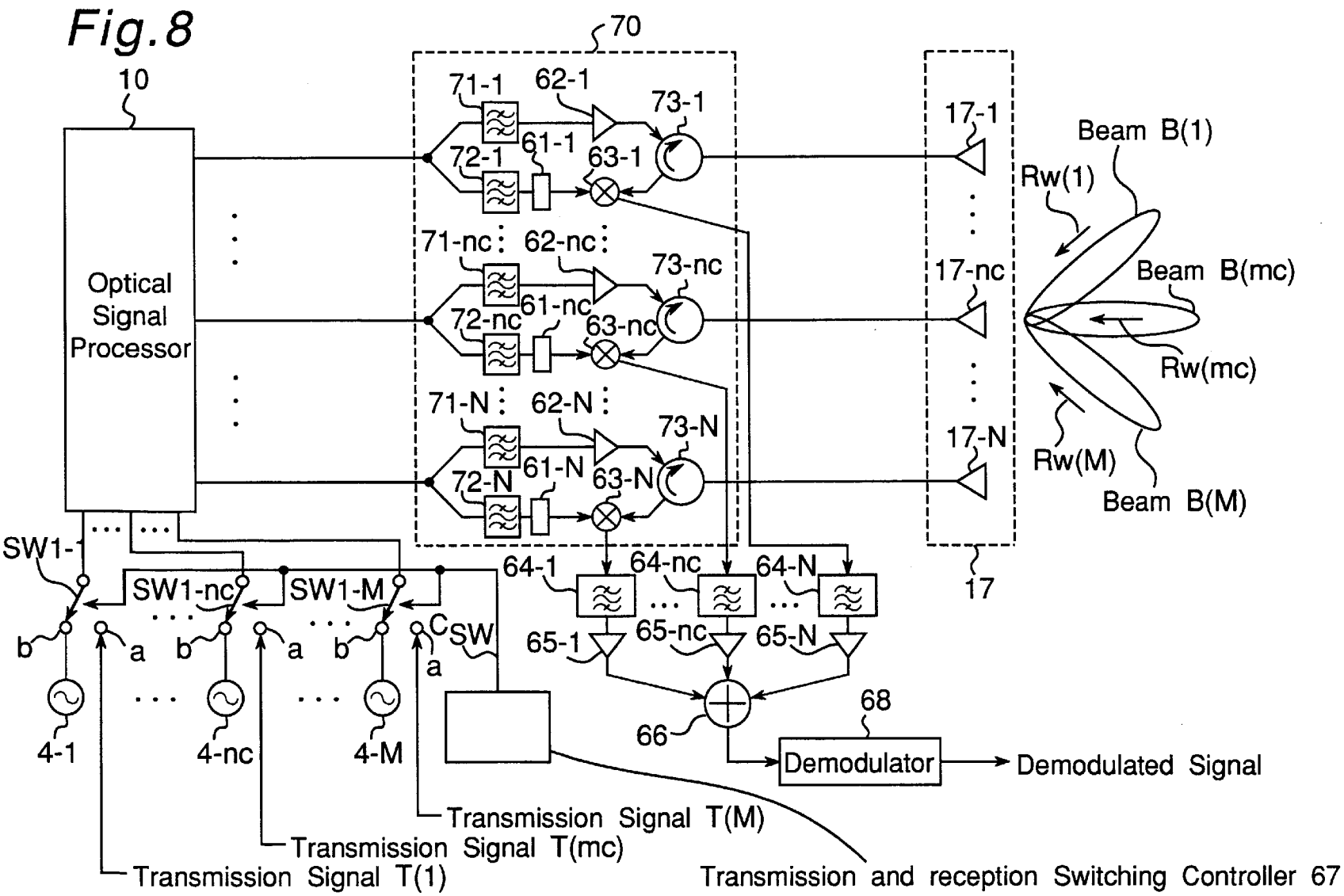
FIG. 8 is a block diagram showing a configuration of an optical control type phased array antenna apparatus according to a second preferred embodiment of the present invention.

FIG. 8 is a block diagram showing a configuration of an optical control type phased array antenna apparatus according to a second preferred embodiment of the present invention. The optical control type phased array antenna apparatus of the second preferred embodiment is characterized in that a transceiver module 70 is used in place of the transceiver module 60 in the optical control type phased array antenna apparatus of the first preferred embodiment shown in FIG. 1, and it can be applied to a case where the frequency of the radio wave signal Rw(m) and the frequency of the transmitting signal T(m) to be transmitted in correspondence with the radio wave signal differ from each other.

That is, as shown in FIG. 8, the transceiver module 70 of the second preferred embodiment is constructed of a combination of circuits comprising a phase inverter 61-n, a power amplifier 62-n, a mixer 63-n, band-pass filters 71-n and 72-n and a circulator 73-n for each antenna element 17-n. In this case, the circulator 73-n has first to third terminals, and the first terminal is connected to each antenna element 17-n. The band-pass filter 71-n, the phase inverter 61-n and the power amplifier 62-n are connected in series between the second terminal of the circulator 73-n and the band-pass filter 15-n of the optical signal processor 10. One input terminal of the mixer 63-n is connected to the third terminal of the circulator 73-n. The phase inverter 61-n and the band-pass filter 72-n are connected in series between the other input terminal of the mixer 63-n and the band-pass filter 15-n.

In this transceiver module 70, the circulator 73-n outputs from the third terminal a signal inputted from the first terminal, and outputs from the first terminal a signal inputted from the second terminal. Further, the band-pass filter 71-n has a pass-band characteristic such that it allows the antenna radiation signal $T_A(n)$ outputted from the optical signal processor 10 to pass therethrough or band-pass-filter and prevents the reference signal Rc(n) from passing. The band-pass filter 72-n has a pass-band characteristic such that it allows the reference signal Rc(n) outputted from the optical signal processor 10 to pass therethrough or band-pass-filter and prevents the antenna radiation signal $T_A(n)$ from passing. In the second preferred embodiment, the transmission frequency and the reception frequency are set at frequencies different from each other. Except for the above-mentioned points, the second preferred embodiment is constructed in a manner similar to that of the first preferred embodiment. In FIG. 8, components similar to those shown in FIG. 1 are denoted by same reference numerals in FIG. 1.

In the optical control type phased array antenna apparatus of the second preferred embodiment constructed as above, each switch SW1-m is switched over to the contact "b" by the transmission and reception switching controller 67 in the stage of reception. By this operation, the reference signal Rc(n) is generated and then outputted in a manner similar to that of the first preferred embodiment. The reference signal Rc(n) is inputted to the mixer 63-n via the band-pass filter 72-n and the phase inverter 61-n, received by the antenna element 17-n and then mixed with a received signal R(n) inputted via the circulator 73-n. In a manner similar to that of the first preferred embodiment, the intermediate frequency signal $IF_A(n)$ obtained through the mixing is inputted to the combiner 66 via the band-pass filter 64-n and the intermediate frequency signal amplifier 65-n, and is demodulated by the demodulator 68 then outputted.

In the stage of transmission, each switch SW1-m is switched over to the contact "a" by the transmission and reception switching controller 67. By this operation, an antenna radiation signal $T_A(n)$ is generated in the optical signal processor 10 and is radiated into a free space from the antenna element 17-n via the power amplifier 63-n and the circulator 73-n to be transmitted with a high-frequency beam corresponding to the transmitting signal T(m) formed in a predetermined direction.

The optical control type phased array antenna apparatus of the second preferred embodiment constructed as above has the same effects as those of the first preferred embodiment.

FIRST MODIFIED PREFERRED EMBODIMENT

Figure 9:
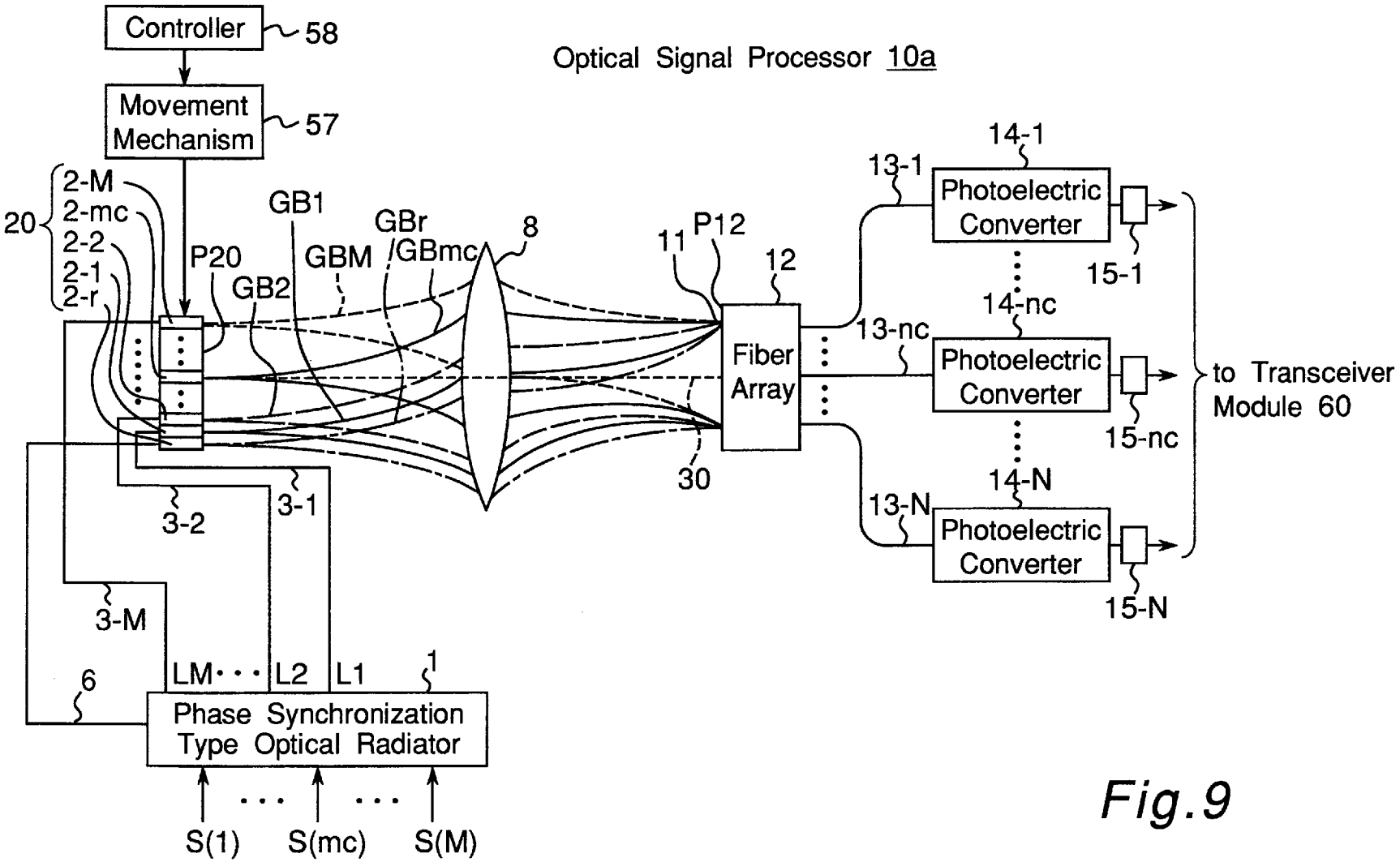
FIG. 9 is a block diagram showing a configuration of an optical signal processor 10*a* of an optical control type phased array antenna apparatus according to a first modified preferred embodiment of the present invention.

FIG. 9 is a block diagram showing a configuration of an optical signal processor 10*a* of an optical control type phased array antenna apparatus according to a first modified preferred embodiment of the present invention.

The optical signal processor 10*a* is characterized in that the optical signal processor 10 shown in FIG. 2 is further provided with a movement mechanism 57 for moving the radiation lens array 20 one-dimensionally in a direction perpendicular to the optical axis 30 and a controller 58 for controlling the operation of the movement mechanism 57.

In the optical control type phased array antenna apparatus of the first modified preferred embodiment, control of the direction in which a receivable radio wave signal comes and the radiating direction of the radiation pattern are executed as follows. That is, based on the direction in which the radio wave signal comes and the desired radiating direction, the controller 58 controls the movement mechanism 57 so that the radiation lens array 20 is moved one-dimensionally in the direction perpendicular to the optical axis 30. The optical control type phased array antenna apparatus of the present modified preferred embodiment operates in a manner similar to that of the optical control type phased array antenna apparatus of the first preferred embodiment shown in FIG. 1 except for the above-mentioned points.

Therefore, in the first modified preferred embodiment shown in FIG. 9, the direction in which the receivable radio wave signal comes and the radiating direction of the transmitting signal can be changed by means of the movement mechanism 57, and further has the same effects as those of the first preferred embodiment.

Furthermore, according to the optical control type phased array antenna apparatus of the above-mentioned modified preferred embodiment shown in FIG. 9, the entire body of the radiation lens array 20 is moved by the movement mechanism 57. However, the present invention is not limited to this, and the GRIN lenses 2-1 to 2-M of the radiation lens array 20 may be moved individually.

THE OTHER MODIFIED PREFERRED EMBODIMENTS

Figure 10:
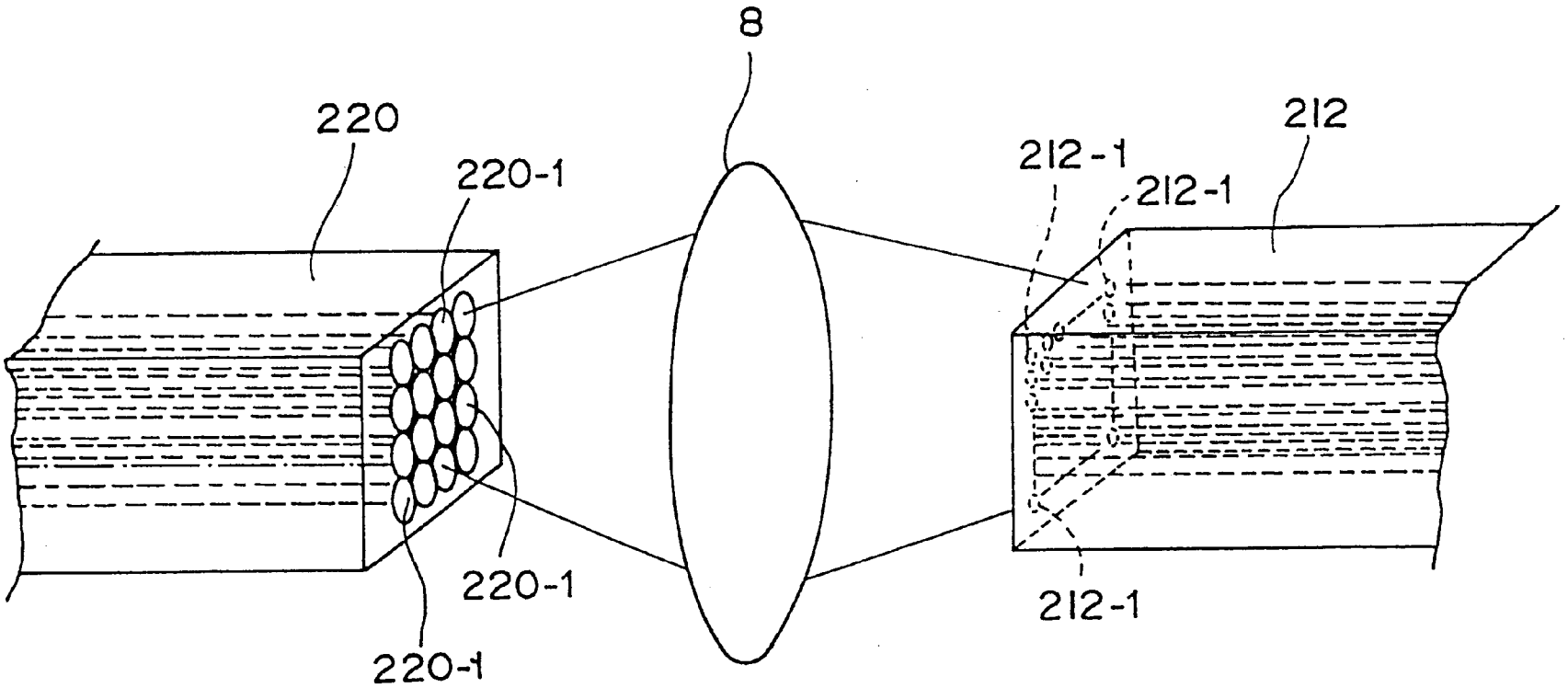
FIG. 10 is a perspective viewgraph showing an optical system in an optical control type phased array antenna apparatus according to the modified preferred embodiment of the present invention.

The above-mentioned first to third preferred embodiments are each constructed of the radiation lens array 20 in which the GRIN lenses 2-1 to 2-M are arranged in one-dimensional direction, the fiber array 12 in which the sampling optical fibers 12-1 to 12-N are arranged in one-dimensional direction and the array antenna 17 in which the antenna elements 17-1 to 17-N are arranged in one-dimensional direction. However, the present invention is not limited to this, and as shown in FIG. 10, it may be constructed of a radiation lens array 220 in which a plurality of GRIN lenses 220-1 are arranged in two-dimensional direction in a matrix form, a fiber array 212 in which a plurality of sampling optical fibers 212-1 are arranged in two-dimensional direction in a matrix form and an array antenna (not shown) in which a plurality of antenna elements are arranged in two-dimensional direction in a matrix form. With the above-mentioned arrangement, the direction in which the receivable radio wave signal comes and the radiating direction of the transmitting signal can be set three-dimensionally, and further has the same effects as those of the first and second preferred embodiments.

Furthermore, the first modified preferred embodiment is constructed by using the movement mechanism 57 for moving the radiation lens array 20 in one-dimensional direction, and the controller 58 for controlling the movement mechanism 57. However, the present invention is not limited to this, and it may be constructed of a movement mechanism for moving the radiation lens array 20 in two-dimensional direction and a controller for controlling the movement mechanism. In this case, by constituting it by a radiation lens array in which a plurality of GRIN lenses 2-1 to 2-M are arranged in two-dimensional direction in a matrix form, a fiber array in which a plurality of sampling optical fibers are arranged in two-dimensional direction in a matrix form and an array antenna in which a plurality of antenna elements are arranged in two-dimensional direction in a matrix form, the direction in which the receivable radio wave signal comes and the radiating direction can be set three-dimensionally, and further has the same effects as those of the first modified preferred embodiment.

In the above-mentioned first to third preferred embodiments, the fiber array 12 is constructed of the sampling optical fibers 12-1 to 12-N. However, the present invention is not limited to this, and it may be constructed of a plurality of optical waveguides formed on a substrate. With the above-mentioned arrangement, it operates in a manner similar to that of the first and second preferred embodiments and has the same effects as those thereof, and the optical waveguides can be formed at narrower intervals than that when the sampling optical fibers 12-1 to 12-N are used for the arrangement. Therefore, the combined beam of light 11 can be spatially sampled at the narrow intervals, thereby allowing the combined beam of light 11 inputted to the input plane P12 to be efficiently sampled.

In the above-mentioned first and second preferred embodiments, the phase synchronization type optical radiator 1 is constructed so that it outputs the plurality of M beams of light L1 to LM having the frequencies of $(fo+f_m(1))$ to $(fo+f_m(M))$ respectively. However, the present invention is not limited to this, and it is acceptable to output a plurality of M beams of light having frequencies of $(fo-f_m(1))$ to $(fo-f_m(M))$, respectively.

Furthermore, in the above-mentioned first and second preferred embodiments, a dipole antenna, a metal patch antenna formed on a dielectric substrate or a horn antenna can be used as the antenna elements 17-1 to 17-N.

SIMULATION

Next, various kinds of simulation results executed with regard to the optical control type phased array antenna apparatus of the above-mentioned first and second preferred embodiments will be described.

Figure 11:
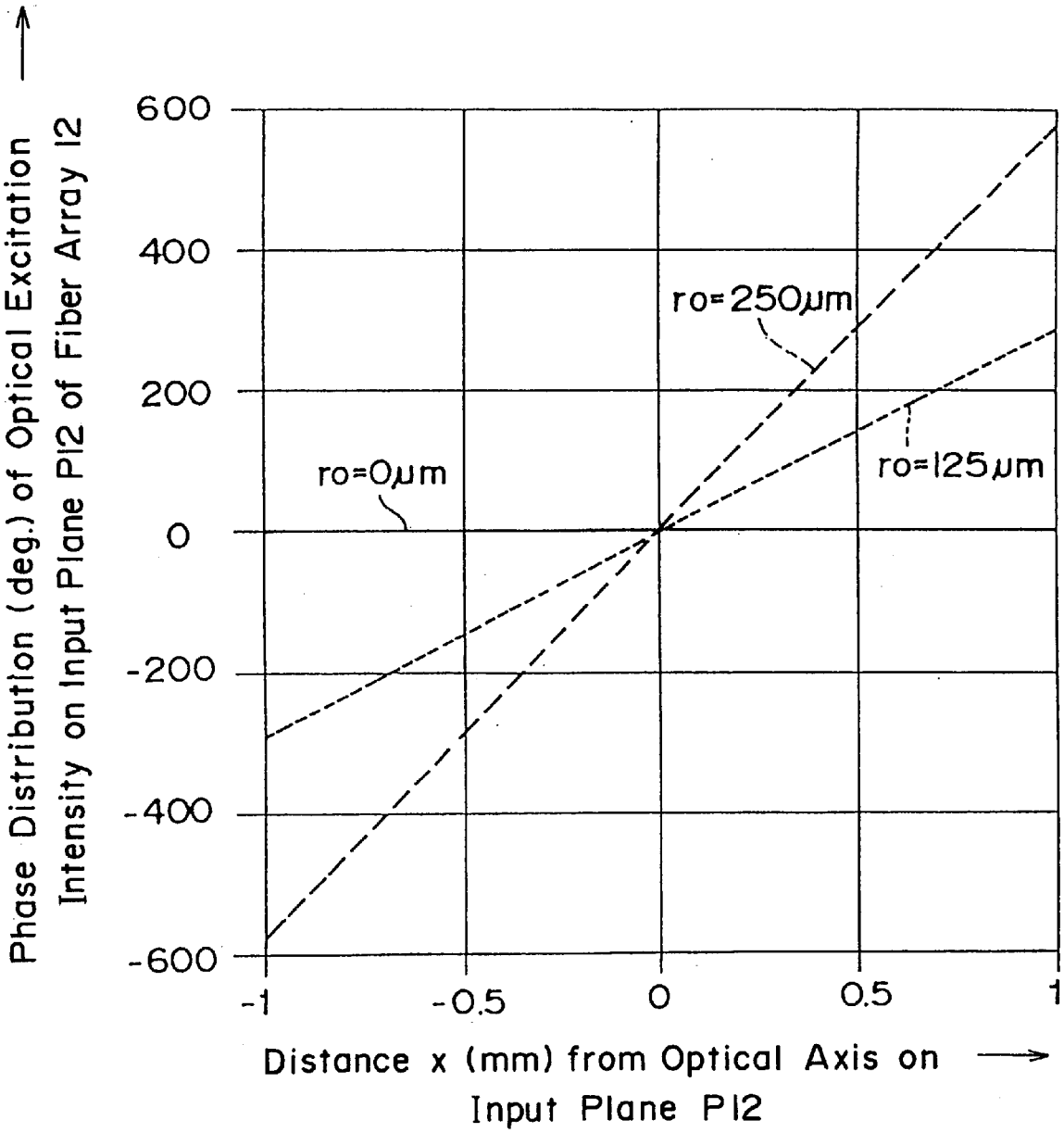
FIG. 11 is a graph showing a phase inclination of a Gaussian distribution beam of light on an input plane P12 of the fiber array 12.

FIG. 11 is a graph showing a phase inclination of a Gaussian distribution beam of light on the input plane P12 when the Gaussian distribution beam of light is radiated from each of positions located apart from the optical axis by a distance ro=0, ro=125 $\mu$m and ro=250 $\mu$m in the optical signal processor 10 of the first and second preferred embodiments. As is apparent from FIG. 11, when the beam of light is radiated on the optical axis (ro=0 $\mu$m), the phase becomes identical at any position on the input plane P12. When the radiating position of the beam of light is separated apart from the optical axis 30 (when ro=125 $\mu$m and ro=250 $\mu$m in FIG. 11), the phase changes linearly with respect to the distance x from the optical axis 30 on the input plane P12. The above-mentioned fact tells that the farther the radiating position is separated apart from the optical axis 30, the further the phase inclination with respect to the distance x increases.

Figure 12:
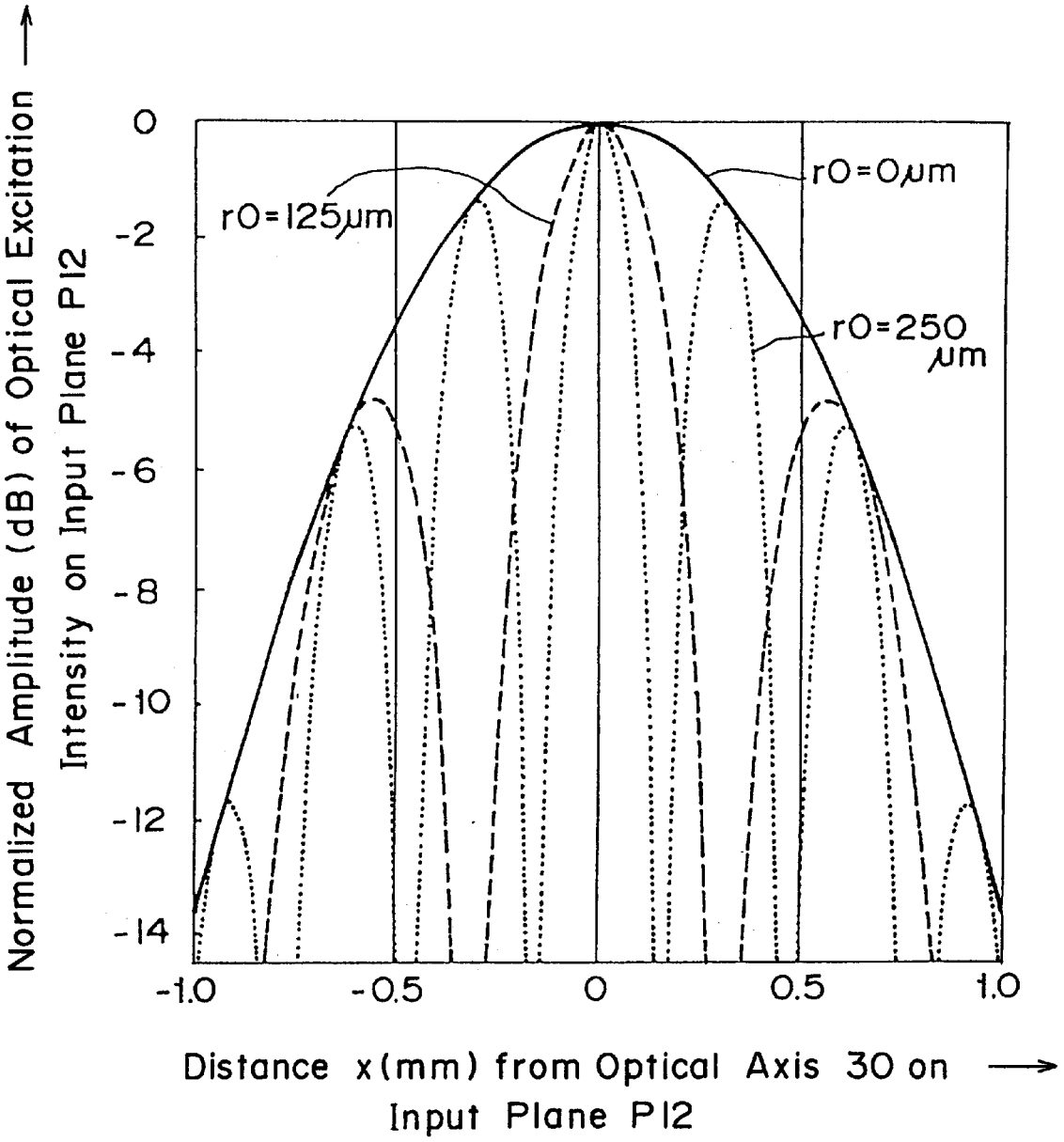
FIG. 12 is a graph showing an optical interference pattern on the input plane P12 excited by the Gaussian distribution beam of light radiated from different positions on a focal plane P20 of the Fourier transformation lens 8 in the optical signal processor 10.

FIG. 12 is a graph showing an interference pattern when the radiating position of the Gaussian distribution beam of light GBr is set at a distance ro=0 $\mu$m from the optical axis 30 and the radiating position of the Gaussian distribution beam of light GBm is set at a distance ro=125 $\mu$m from the optical axis 30 in the optical signal processor 10 of the first and second preferred embodiments. The graph shown in FIG. 12 was calculated by means of the equation (10), and principal parameters other than the distance ro were the beam waist diameter $\omega_0$=62.5 $\mu$m of the Gaussian distribution beam, the focal distance F=120 mm of the Fourier transformation lens 8, and the wavelength $\lambda_0$=1.3 $\mu$m of the beam of light, set as above. In FIG. 12, the solid line indicated with ro=0 $\mu$m is the envelope of the interference pattern averaged in time as a Gaussian distribution. The dotted line indicated with ro=125 $\mu$m shows an interference pattern of the change in time of the Gaussian distribution beam of light GBm radiated from the position at the distance ro=125 $\mu$m from the optical axis 30 and the Gaussian distribution beam of light GBr. The dotted line indicated with ro=250 $\mu$m shows an interference pattern of the change in time of the reference Gaussian distribution beam of light GBm radiated from the position at the distance ro=250 $\mu$m from the optical axis 30 and the Gaussian distribution beam of light GBr. As is apparent from FIG. 12, it can be found that an interference pattern having an optical excitation intensity corresponding to the radiating position of the Gaussian distribution beam of light GBm can be obtained on the input plane P12.

Figure 13:
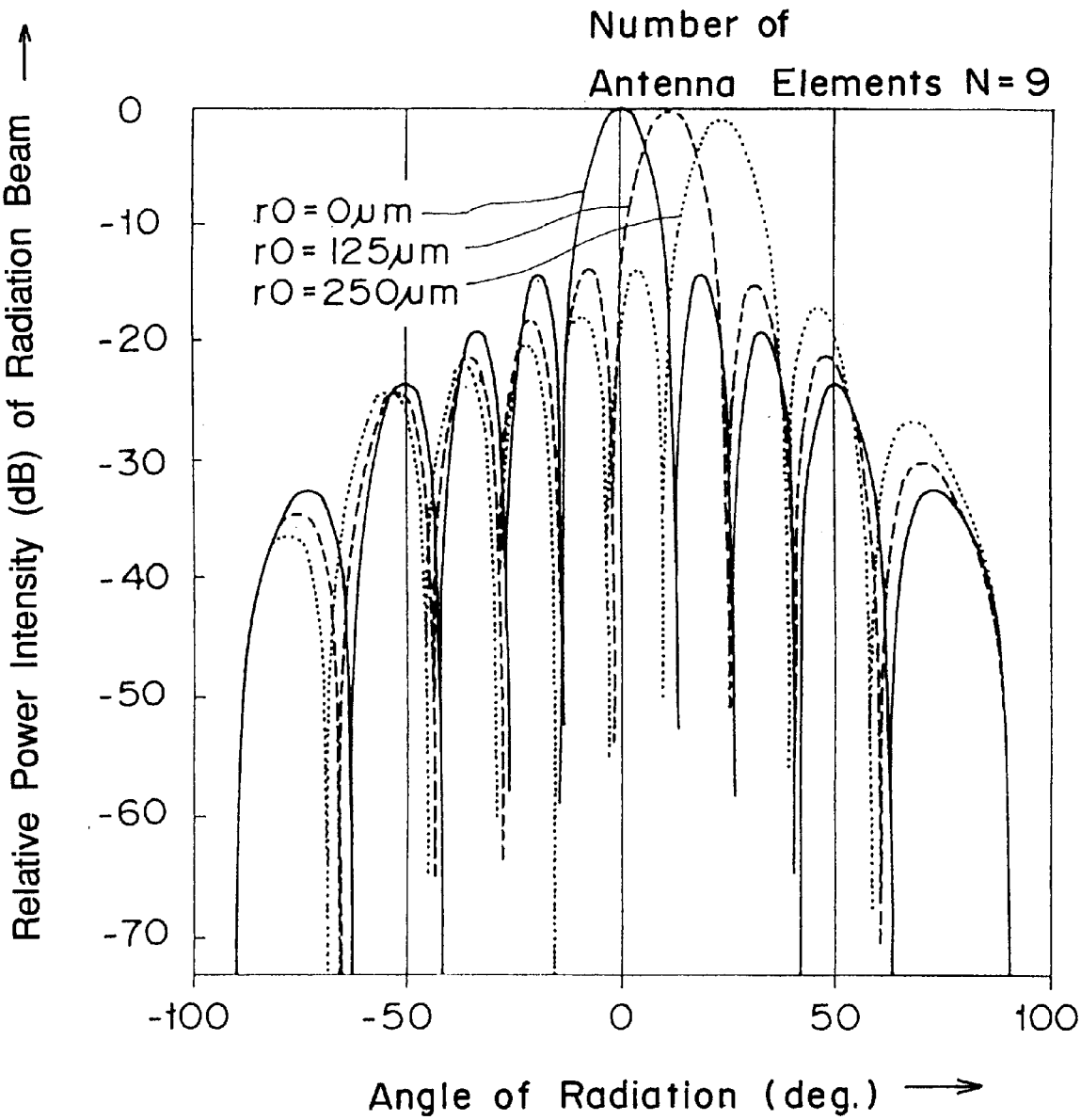
FIG. 13 is a graph showing a relative power intensity with respect to the angles of radiation beams radiated from an array antenna apparatus in correspondence with each Gaussian distribution beam of light GBm when a reference Gaussian distribution beam of light GBr is radiated from a position located apart from the optical axis 30.

FIG. 13 is a graph showing a relative power intensity with respect to the angles of radiation beams radiated from the array antenna 17 when the position in which the Gaussian distribution beam of light is radiated is varied on the focal plane P20. The graph shown in FIG. 13 shows a simulation in the case where the Gaussian distribution beam GBm is radiated from three different positions at distance ro=0 $\mu$m, ro=125 $\mu$m and ro=250 $\mu$m from the optical axis 30 by means of the equation (16). According to the simulation, the reference Gaussian distribution beam of light GBr was radiated as separated apart from the optical axis 30, the other principal parameters other than the distance ro were the number N=9 of the antenna elements 17, the sampling optical fiber interval $d_1$=125 $\mu$m, the beam waist diameter $\omega_0$=62.5 $\mu$m of the Gaussian distribution beam, the focal distance F=120 mm of the Fourier transformation lens 8, the wavelength $\lambda_0$=1.3 $\mu$m of the beam of light, set as above, and the antenna element interval set at one half of the wavelength of the radio signal to be radiated. Furthermore, in FIG. 13, the relative amplitude is shown as normalized with the maximum amplitude of the radiation beam corresponding to the Gaussian distribution beam radiated from the optical axis (distance ro=0 $\mu$m). As is apparent from the graph shown in FIG. 13, it can be found that the farther the position in which the Gaussian distribution beam is radiated is separated apart from the optical axis 30 on the focal plane P20, the further the beam angle of the radiation beam radiated from the array antenna 17 increases. That is, the figure shows the fact that the beam angle of the radiation beam radiated from the array antenna 17 can be set to a predetermined value by setting the position in which the Gaussian distribution beam is radiated at a predetermined position. In this case, the beam angle means an angle between the direction of the main beam of the radiation beam and the vertical direction of the radiation plane of the array antenna 17.

Figure 14:
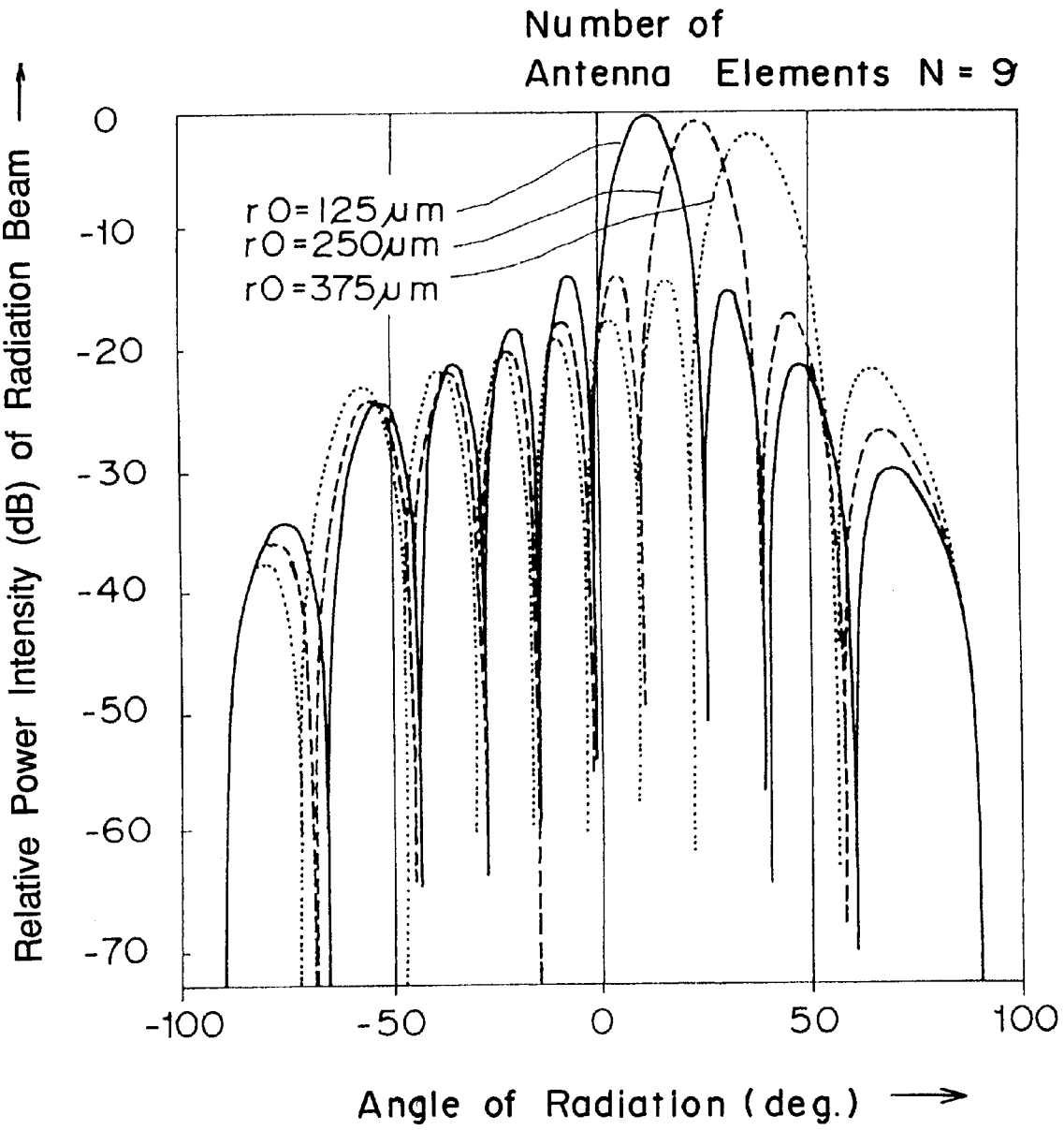
FIG. 14 is a graph showing a relative power intensity with respect to the angles of radiation beams radiated from the array antenna apparatus in correspondence with each Gaussian distribution beam of light GBm when the reference Gaussian distribution beam of light GBr is radiated from the optical axis 30.

FIG. 14 is a graph showing a relative power intensity with respect to the angles of radiation beams radiated from the array antenna 17 when the position in which the Gaussian distribution beam is radiated is varied on the focal plane P20. The graph of FIG. 14 shows a simulation in the case where the Gaussian distribution beam is radiated from three different positions at distance ro=125 $\mu$m, ro=250 $\mu$m and ro=375 $\mu$m from the optical axis 30 by means of the equation (16). According to the simulation, the reference Gaussian distribution beam of light was radiated from the optical axis 30, and the other principal parameters other than the distance ro were set in a manner similar to that of the simulation shown in FIG. 13. By comparing the graph in which ro is set at ro=125 $\mu$m and ro=250 $\mu$m shown in FIG. 13 with the graph in which ro is set at ro=125 $\mu$m and ro=250 $\mu$m shown in FIG. 14, it can be found that the radiation beam can be formed in the desired direction depending on only the distance ro regardless of the radiating position of the reference Gaussian distribution beam of light.

Figure 15:
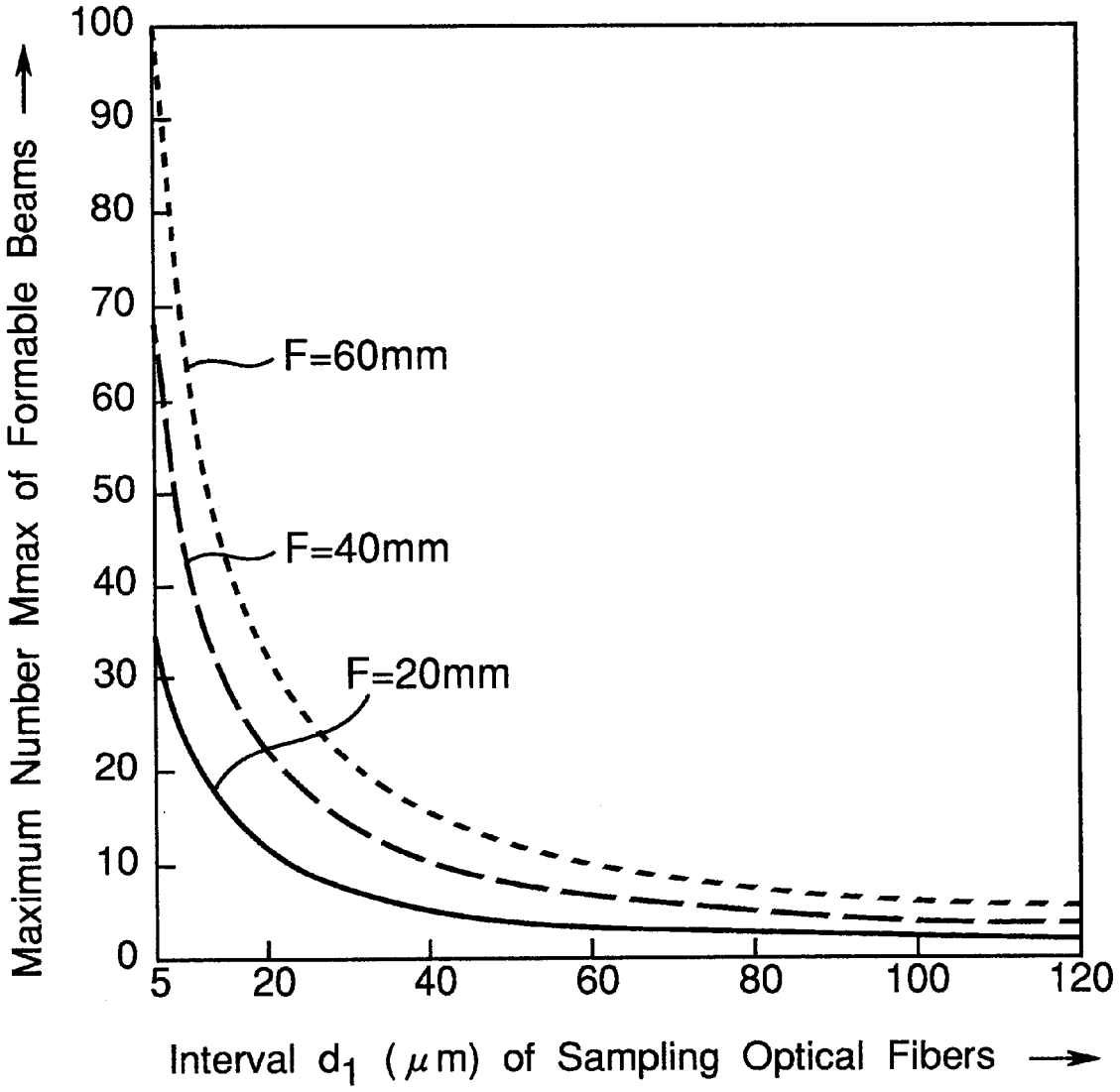
FIG. 15 is a graph showing a maximum number Mmax of beams which can be formed with respect to an interval $d_1$ of sampling fibers in the first and second preferred embodiments.
Figure 16:
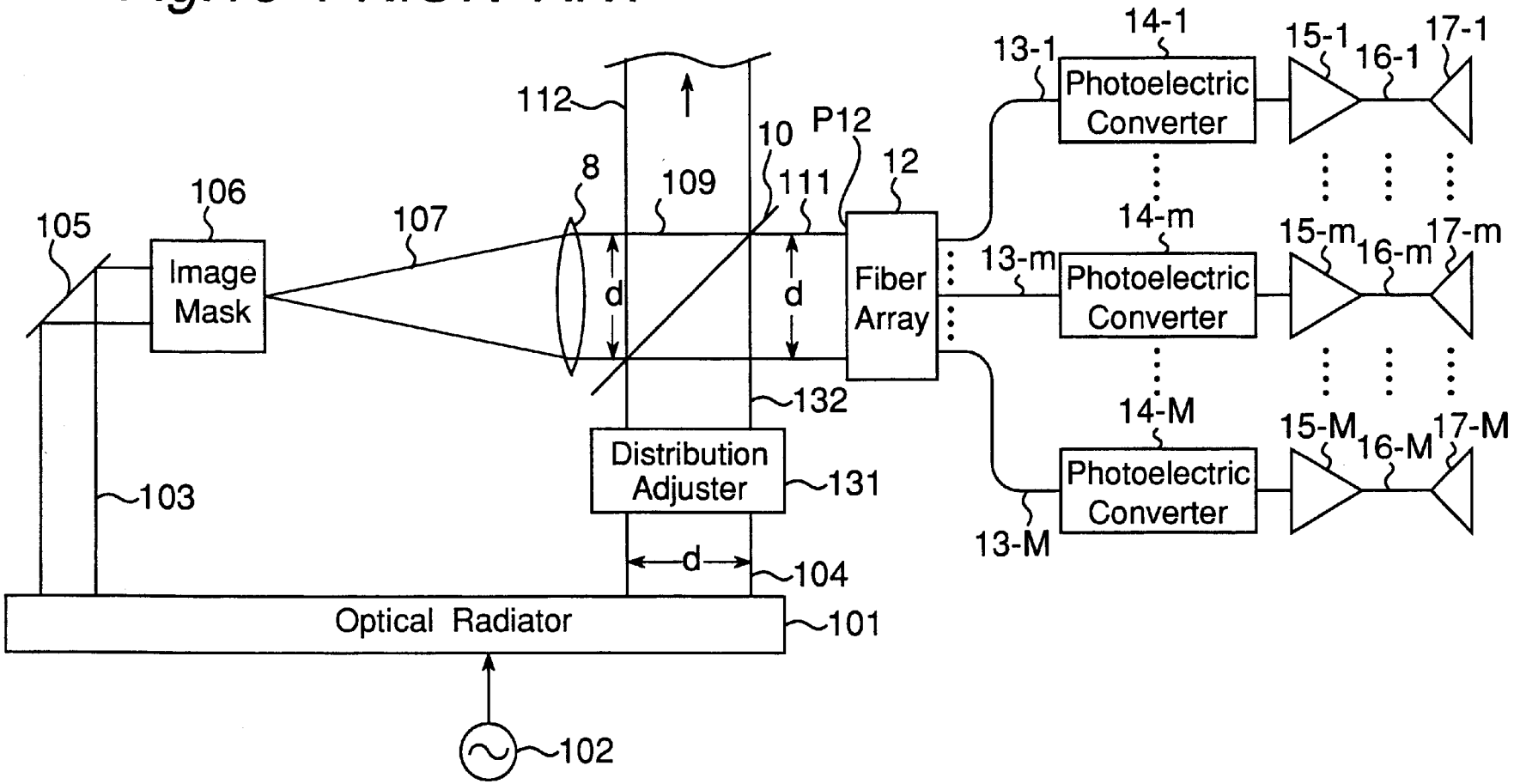
Fig.16 PRIOR ART
FIG. 16 is a block diagram showing a configuration of a prior art optical control type phased array antenna apparatus.

FIG. 15 is a graph showing the result of calculation by means of the equation (9). That is, FIG. 15 shows a maximum number Mmax of beams which can be formed with respect to the interval $d_1$ of the sampling fiber 12-m. FIG. 15 also shows the cases where the focal distance F of the Fourier transformation lens 8 is set at 20 mm, 40 mm and 60 mm. As is apparent from FIG. 15, it can be found that the narrower the interval of the sampling optical fibers 12-m is set, the further the maximum number Mmax of the formable beams can be increased. Furthermore, it can be found that the longer the focal distance F is set, the further the maximum number Mmax of the formable beams can be increased. Furthermore, the same thing can be said for the number of receivable radio wave signals.

As is apparent from the above-mentioned description, the optical control type phased array antenna apparatus of the present invention is provided with the optical signal processing means for outputting an optically processed signal including M signal components corresponding to the directions in which the radio wave signals come, the plurality of N mixers each for mixing the received signal received by the corresponding antenna element with the optically processed signal to output frequency-converted signals, and the combiner for combining the plurality of N frequency-converted signals. With the above-mentioned arrangement, a plurality of radio wave signals coming in predetermined directions can be received.

Furthermore, according to an aspect of the present invention, the optical signal processing means is constructed of light generating means for outputting a reference beam of light set at a reference frequency and a plurality of M signal-processed beams of light each set at a frequency that differs by the frequency of each input high-frequency signal from the reference frequency, light radiating means for radiating the signal-processed beams of light in substantially identical directions from the positions corresponding to the directions in which the radio wave signals come and radiating the reference beam of light in directions substantially identical to the directions of the signal-processed beams of light, light converging means for converging each signal-processed beam of light and the reference beam of light on a predetermined image plane so as to form interference fringes, a sampling array for outputting a plurality of N sampled beams of light by spatially sampling the interference fringes, and photoelectric converting means for photoelectrically converting the sampled beams of light. With the above- mentioned arrangement, a compact and simple configuration can be achieved.

Furthermore, according to another aspect of the present invention, M phase inverting means for inverting the phases of the optically processed signals and outputting the resulting signals to the corresponding antenna elements are provided. With the above-mentioned arrangement, when the M transmitting signals modulated by a predetermined modulation method are inputted to the optical signal processing means, high-frequency beams can be formed in the directions in which the plurality of M radio wave signals come to allow the corresponding transmitting signals to be radiated into a free space.

Furthermore, according to a further aspect of the present invention, M input switching means for switching between each transmitting signal and the reference signal and outputting the resulting signal to the optical signal processing means and control means for controlling the input switching means so that the transmitting signal is inputted in the stage of transmission and the reference signal is inputted in the stage of reception are provided. With the above-mentioned arrangement, the switching between transmission and reception can be easily achieved.

Furthermore, according to a still further aspect of the present invention, first switching means for executing switching so that the optically processed signal is inputted to the mixer or the phase inverting means and second switching means for executing switching so that the received signal received by each antenna element is inputted to the mixer or the signal outputted from the phase inverting means is inputted to each antenna element are further provided, whereby the control means control the first and second switching means so that the optically processed signal is transmitted to the antenna element via the phase inverting means in the stage of transmission and the optically processed signal and the received signal received by each antenna element are inputted to the mixer in the stage of reception. With the above-mentioned arrangement, the optical signal processing means can be synchronized with a transmission and reception circuit comprising the mixer and the phase inverting means, thereby allowing the switching between transmission and reception to be achieved.

Furthermore, according to a still more further aspect of the present invention, a circulator which outputs the signal inputted from the phase inverting means via a first terminal to the antenna element via a second terminal and outputs the received signal inputted from the antenna element via the second terminal to the mixer via a third terminal, a first band-pass filter which allows the signal having a frequency equal to that of each transmitting signal out of inputted optically processed signals to pass therethrough and inputs the resulting signal to the phase inverting means, and a second band-pass filter which allows a reference signal having a frequency equal to that of the first high-frequency signal out of the inputted optically processed signals to pass therethrough and inputs the reference signal to the mixer are provided. With the above-mentioned arrangement, the switching between transmission and reception can be also achieved.

Furthermore, according to a more still further aspect of the present invention, moving means for moving the radiating means is provided. With the above-mentioned arrangement, the direction in which each receivable radio wave signal comes and the direction in which each high-frequency beam is formed can be changed.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An optical control type phased array antenna apparatus comprising:

an array antenna comprising a plurality of antenna elements, said array antenna receiving a plurality of radio wave signals from respective predetermined directions and outputting received radio wave signals;

optical signal processing means for optically processing input high-frequency signals, and outputting a plurality of optically processed signals, said optically processed signals including signal components having phases corresponding to directions from which the respective radio wave signals arrive and having frequencies equal to those of the input high-frequency signals, said plurality of optically processed signals respectively corresponding to said antenna elements;

a plurality of frequency converting means, provided in correspondence with said antenna elements, each of said frequency converting means mixing a received signal received signal outputted from said optical signal processing means in correspondence with said antenna element, and outputting a frequency-converted signal having a frequency of a difference between a frequency of the received signal and a frequency of the optically processed signal; and combiner means for combining a plurality of frequency-converted signals outputted from said plurality of frequency converting means, wherein, when a plurality of reference signals each having a frequency that differs from the frequency of the corresponding radio wave signal by an intermediate frequency are inputted to said optical signal processing means as said input high-frequency signals, intermediate frequency signals having the intermediate frequencies and corresponding to the radio wave signals are outputted as received signals from said combiner means.

2. The optical control type phased array antenna apparatus as claimed in claim 1, wherein said optical signal processing means comprises:

light generating means for generating and outputting a reference beam of light having a reference frequency, and a plurality of signal-processed beams of light each having a phase equal to that of said reference beam of light and having a frequency that differs by the frequency of the corresponding input high-frequency signal from said reference frequency;

light radiating means for radiating the signal-processed beams of light in substantially identical directions from positions corresponding to the directions in which the respective radio wave signals come and for radiating said reference beam of light in directions substantially equal to the directions of said signal-processed beams of light;

light converging means for converging said signal-processed beams of light and said reference beam of light radiated from said light radiating means on a predetermined image plane, and for forming interference fringes on said image plane;

sampling array means having a plurality of N light detecting means provided at positions corresponding to said antenna elements on said image plane, said sampling array means spatially sampling the interference fringes formed by said light converging means and outputting a plurality of sampled beams of light corresponding to said antenna elements; and photoelectric converting means for photoelectrically converting said sampled beams of light, and outputting a plurality of optically processed signals.

3. The optical control type phased array antenna apparatus as claimed in claim 1, further comprising:

a plurality of phase inverting means provided in correspondence with said antenna elements, for inverting phases of said optically processed signals outputted from said optical signal processing means in either one of the stage of reception and the stage of transmission, and for outputting phase-inverted signals to said respective frequency converting means in the stage of reception and outputting phase-inverted signals to said respective antenna elements in the stage of transmission, wherein, when transmitting signals modulated by a predetermined modulation method are inputted as said input high-frequency signals to said optical signal processing means, high-frequency beams are formed in the directions in which said radio wave signals come by radiating said optically processed signals through said respective antenna elements, thereby radiating corresponding transmitting signals into a free space.

4. The optical control type phased array antenna apparatus as claimed in claim 2, further comprising:

a plurality of phase inverting means provided in correspondence with said antenna elements, for inverting phases of said optically processed signals outputted from said optical signal processing means in either one of the stage of reception and the stage of transmission, and for outputting phase-inverted signals to said respective frequency converting means in the stage of reception and outputting phase-inverted signals to said respective antenna elements in the stage of transmission, wherein, when transmitting signals modulated by a predetermined modulation method are inputted as said input high-frequency signals to said optical signal processing means, high-frequency beams are formed in the directions in which said radio wave signals come by radiating said optically processed signals through said respective antenna elements, thereby radiating corresponding transmitting signals into a free space.

5. The optical control type phased array antenna apparatus as claimed in claim 3, further comprising:

a plurality of input switching means provided in correspondence with the directions in which said radio wave signals come, for selectively switching over between said transmitting signal and said reference signal, and for outputting switched resulting signal to said optical signal processing means; and control means for controlling said input switching means so that the transmitting signal is inputted to said optical signal processing means in the stage of transmission and the reference signal is inputted to said optical signal processing means in the stage of reception.

6. The optical control type phased array antenna apparatus as claimed in claim 4, further comprising:

a plurality of input switching means provided in correspondence with the directions in which said radio wave signals come, for selectively switching over between said transmitting signal and said reference signal, and for outputting switched resulting signal to said optical signal processing means; and control means for controlling said input switching means so that the transmitting signal is inputted to said optical signal processing means in the stage of transmission and the reference signal is inputted to said optical signal processing means in the stage of reception.

7. The optical control type phased array antenna apparatus as claimed in claim 5, further comprising:

first switching means provided in correspondence with said antenna elements, for executing switching so that each optically processed signal outputted from said optical signal processing means is selectively inputted to either said frequency converting means or said phase inverting means; and second switching means provided in correspondence with said antenna elements, for executing switching so that each received signal received by each of said antenna elements is inputted to said frequency converting means or each signal outputted from said phase inverting means is inputted to said corresponding antenna element, wherein said control means controls said first and second switching means so that said optically processed signal is transmitted to said antenna element via said phase inverting means in the stage of transmission and said optically processed signal and the received signal received by each of said antenna elements is inputted to said frequency converting means in the stage of reception.

8. The optical control type phased array antenna apparatus as claimed in claim 6, further comprising:

first switching means provided in correspondence with said antenna elements, for executing switching so that each optically processed signal outputted from said optical signal processing means is selectively inputted to either said frequency converting means or said phase inverting means; and second switching means provided in correspondence with said antenna elements, for executing switching so that each received signal received by each of said antenna elements is inputted to said frequency converting means or each signal outputted from said phase inverting means is inputted to said corresponding antenna element, wherein said control means controls said first and second switching means so that said optically processed signal is transmitted to said antenna element via said phase inverting means in the stage of transmission and said optically processed signal and the received signal received by each of said antenna elements is inputted to said frequency converting means in the stage of reception.

9. The optical control type phased array antenna apparatus as claimed in claim 5, further comprising:

a plurality of circulators provided in correspondence with said antenna elements, each of said circulators having first, second and third terminals, each of said circulators outputting a signal inputted from said phase inverting means via the first terminal to said corresponding antenna element via the second terminal and outputting each received signal inputted from said corresponding antenna element via the second terminal to said frequency converting means via the third terminal;

a plurality of first band-pass filters provided in correspondence with said phase inverting means, each of said N first band-pass filters band-pass-filtering a signal having a frequency equal to that of the transmitting signal out of inputted said optically processed signals and for outputting a band-pass-filtered signal to said phase inverting means; and a plurality of second band-pass filters provided in correspondence with said frequency converting means, each of second band-pass filters band-pass-filtering a reference signal having a frequency equal to that of the input high-frequency signal out of inputted said optically processed signals and for outputting a band-pass-filtered reference signal to said frequency converting means.

10. The optical control type phased array antenna apparatus as claimed in claim 6, further comprising:

a plurality of circulators provided in correspondence with said antenna elements, each of said circulators having first, second and third terminals, each of said circulators outputting a signal inputted from said phase inverting means via the second terminal and outputting each received signal inputted from said corresponding antenna element via the second terminal to said frequency converting means via the third terminal;

a plurality of first band-pass filters provided in correspondence with said phase inverting means, each of said N first band-pass filters band-pass-filtering a signal having a frequency equal to that of the transmitting signal out of inputted said optically processed signals and for outputting a band-pass-filtered signal to said phase inverting means; and a plurality of second band-pass filters provided in correspondence with said frequency converting means, each of second band-pass filters band-pass-filtering a reference signal having a frequency equal to that of the input high-frequency signal out of inputted said optically processed signals and for outputting a band-pass-filtered reference signal to said frequency converting means.

11. The optical control type phased array antenna apparatus as claimed in claim 1, wherein said optical signal processing means further comprises moving means for moving said radiating means.

12. The optical control type phased array antenna apparatus as claimed in claim 2, wherein said optical signal processing means further comprises moving means for moving said radiating means.

13. The optical control type phased array antenna apparatus as claimed in claim 3, wherein said optical signal processing means further comprises moving means for moving said radiating means.

14. The optical control type phased array antenna apparatus as claimed in claim 4, wherein said optical signal processing means further comprises moving means for moving said radiating means.

* * * * *